US012528572B2

(12) United States Patent
Ikegaya et al.

(10) Patent No.: US 12,528,572 B2
(45) Date of Patent: Jan. 20, 2026

(54) WATERCRAFT PROPULSION SYSTEM, AND WATERCRAFT

(71) Applicant: YAMAHA HATSUDOKI KABUSHIKI KAISHA, Iwata (JP)

(72) Inventors: Yuji Ikegaya, Shizuoka (JP); Tensho Kajihara, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 180 days.

(21) Appl. No.: 18/381,211

(22) Filed: Oct. 18, 2023

(65) Prior Publication Data

US 2024/0132191 A1 Apr. 25, 2024
US 2024/0228001 A9 Jul. 11, 2024

(30) Foreign Application Priority Data

Oct. 19, 2022 (JP) ..... 2022-167329

(51) Int. Cl.
*B63H 20/12* (2006.01)
*B63H 20/00* (2006.01)
*B63H 25/42* (2006.01)

(52) U.S. Cl.
CPC ..... *B63H 20/12* (2013.01); *B63H 25/42* (2013.01); *B63H 2020/003* (2013.01)

(58) Field of Classification Search
CPC .. B63H 20/12; B63H 25/42; B63H 2020/003; B63H 25/02; B63H 2025/026; B63H 21/17; B63H 21/213
See application file for complete search history.

(56) References Cited

U.S. PATENT DOCUMENTS 8,589,004 B1 * 11/2013 Kanno ..... B63H 25/42 440/4
9,487,283 B2 11/2016 Inoue et al.
(Continued)

FOREIGN PATENT DOCUMENTS

JP 2013-163439 A 8/2013
JP 2015-209144 A 11/2015

OTHER PUBLICATIONS

Official Communication issued in corresponding European Patent Application No. 23202935.5, mailed on Mar. 25, 2024.

*Primary Examiner* — Brandon D Lee
(74) *Attorney, Agent, or Firm* — Keating & Bennett, LLP

(57) ABSTRACT

A watercraft propulsion system includes a first propulsion device attachable to a hull, a second propulsion device attachable to the hull adjacent to the first propulsion device, a first steering device to steer the first propulsion device, a second steering device to steer the second propulsion device, and a controller configured or programmed to control the first propulsion device, the second propulsion device, the first steering device, and the second steering device. The controller is configured or programmed to determine whether or not a predetermined load torque increase condition is satisfied in which a steering load torque of the second propulsion device is likely to be increased by a water jet generated by the first propulsion device, and to perform a propulsive force restricting control to restrict the propulsive forces of the first propulsion device and the second propulsion device if the predetermined load torque increase condition is satisfied.

11 Claims, 17 Drawing Sheets

(56) References Cited

U.S. PATENT DOCUMENTS

| | | | | |
|---|---|---|---|---|
| 2005/0282447 | A1* | 12/2005 | Okuyama | B63H 20/08 440/53 |
| 2007/0178779 | A1* | 8/2007 | Takada | B63H 21/22 114/144 RE |
| 2011/0166724 | A1* | 7/2011 | Hiramatsu | B63H 25/42 702/85 |
| 2014/0329422 | A1* | 11/2014 | Ito | B63H 5/08 440/1 |
| 2015/0246714 | A1 | 9/2015 | Morikami et al. | |
| 2015/0307176 | A1 | 10/2015 | Nakayasu | |
| 2022/0252153 | A1* | 8/2022 | Snyder | F16H 59/74 |

* cited by examiner

WATERCRAFT PROPULSION SYSTEM, AND WATERCRAFT

CROSS REFERENCE TO RELATED APPLICATIONS

This application claims the benefit of priority to Japanese Patent Application No. 2022-167329 filed on Oct. 19, 2022. The entire contents of this application are hereby incorporated herein by reference.

BACKGROUND OF THE INVENTION

1. Field of the Invention

The present invention relates to a watercraft propulsion system, and a watercraft including the watercraft propulsion system.

2. Description of the Related Art

US 2015/0246714 A1 discloses a watercraft that includes two outboard motors attached to the rear side of its hull and is capable of controlling the outboard motors by operating a joystick. The watercraft is capable of taking a forward behavior, a reverse behavior, a rightward translation behavior, a leftward translation behavior, a fixed-point right turning behavior, and a fixed-point left turning behavior according to the operation of the joystick. That is, the steering states and the shift positions of the two outboard motors are controlled so as to provide any of these watercraft behaviors. For the forward behavior and the reverse behavior, the two outboard motors are steered generally parallel at the same shift position (a forward shift position or a reverse shift position). For the rightward translation behavior and the leftward translation behavior, the two outboard motors are steered with their center lines extending in an inverted V-shape toward a hull moving center (i.e., the two outboard motors are steered in a toe-in orientation), and one of the two outboard motors is set in the forward shift position and the other outboard motor is set in the reverse shift position. For the fixed-point right turning behavior and the fixed-point left turning behavior, the two outboard motors are steered in parallel or substantially parallel, and one of the two outboard motors is set in the forward shift position and the other outboard motor is set in the reverse shift position.

SUMMARY OF THE INVENTION

The inventor of preferred embodiments of the present invention described and claimed in the present application conducted an extensive study and research regarding a watercraft propulsion system, such as the one described above, and in doing so, discovered and first recognized new unique challenges and previously unrecognized possibilities for improvements as described in greater detail below.

The inventor of preferred embodiments of the present invention conducted studies to control a watercraft behavior by controlling the steering states of plural propulsion devices in a manner different from that shown in US 2015/0246714 A1.

Preferred embodiments of the present invention provide watercraft propulsion systems that are each able to properly control watercraft behavior by controlling the steering states of a plurality of propulsion devices in a manner different from the conventional manner, and watercraft including the watercraft propulsion systems.

Further preferred embodiments of the present invention provide watercraft propulsion systems that are each able to solve a problem which is likely to occur when the watercraft behavior is controlled by controlling the steering states of a plurality of propulsion devices in a manner different from the conventional manner, and watercraft including the watercraft propulsion systems.

In order to overcome the previously unrecognized and unsolved challenges described above, a preferred embodiment of the present invention provides a watercraft propulsion system including a first propulsion device attachable to a hull in a steerable manner (in a laterally pivotable manner, a second propulsion device attachable to the hull adjacent to the first propulsion device in a steerable manner, a first steering device to steer the first propulsion device, a second steering device to steer the second propulsion device, and a controller configured or programmed to control the first propulsion device, the second propulsion device, the first steering device, and the second steering device. The controller is configured or programmed to determine whether or not a predetermined load torque increase condition is satisfied in which a steering load torque of the second propulsion device is likely to be increased by a water jet generated by the first propulsion device, and to perform a propulsive force restricting control to restrict the propulsive forces of the first propulsion device and the second propulsion device if the predetermined load torque increase condition is satisfied.

With this arrangement, if the water jet generated by one of the two adjacent propulsion devices (the first propulsion device) is likely to increase the steering load torque of the other propulsion device (the second propulsion device), the propulsive forces of the two propulsion devices (the first propulsion device and the second propulsion device) are restricted. Thus, the two propulsion devices are each steerable to a proper steering angle without any substantial influence of a water jet generated by either one of the propulsion devices, making it possible to apply the propulsive forces in proper directions to the hull. Thus, even if the steering states of the plurality of propulsion devices are controlled in a manner different from the conventional manner, the watercraft behavior is properly controlled. This makes it possible to steer the propulsion devices to the proper steering angles while preventing the steering load torque from being excessively increased.

In a preferred embodiment of the present invention, the propulsive force restricting control includes a propulsive force reducing control to control the propulsive forces of the first propulsion device and the second propulsion device to be lower than their target propulsive forces until the second propulsion device is completely steered to its target steering angle.

With this arrangement, the propulsive forces of the two adjacent propulsion devices are controlled to be lower than their target propulsive forces until the other propulsion device (the second propulsion device) which is otherwise likely to be influenced by the water jet generated by the one propulsion device (the first propulsion device) is completely steered to its target steering angle. This makes it possible to reliably steer the two propulsion devices to their target steering angles while preventing the steering load torque from being excessively increased.

In a preferred embodiment of the present invention, the propulsive force restricting control includes a propulsive force generation prohibiting control to prohibit the first propulsion device and the second propulsion device from generating the propulsive forces until the second propulsion device is completely steered to its target steering angle.

With this arrangement, the two adjacent propulsion devices are prohibited from generating the propulsive forces until the other propulsion device (the second propulsion device) which is otherwise likely to be influenced by the water jet generated by the one propulsion device (the first propulsion device) is completely steered to its target steering angle. This makes it possible to reliably steer the two propulsion devices to their target steering angles while preventing the steering load torque from being excessively increased.

In a preferred embodiment of the present invention, the predetermined load torque increase condition includes a steering angle condition such that a first target steering angle is set for the first propulsion device so as to direct the water jet generated by the first propulsion device toward the second propulsion device and a second target steering angle is set for the second propulsion device so as to steer the second propulsion device in a direction against the water jet.

With this arrangement, the propulsive force restricting control is performed when the steering load torque is otherwise likely to be excessively increased due to a steering angle relationship between the two adjacent propulsion devices (the first propulsion device and the second propulsion device). This makes it possible to reliably steer the two propulsion devices to their target steering angles.

In a preferred embodiment of the present invention, the predetermined load torque increase condition includes a steering angle condition such that a first target steering angle and a second target steering angle are respectively set for the first propulsion device and the second propulsion device so as to steer the first propulsion device and the second propulsion device to move the rear ends of the first propulsion device and the second propulsion device toward each other.

With this arrangement, the propulsive force restricting control is performed when the steering load torque is otherwise likely to be excessively increased due to a steering angle relationship between the two adjacent propulsion devices (the first propulsion device and the second propulsion device). This makes it possible to reliably steer the two propulsion devices to the their target steering angles.

In a preferred embodiment of the present invention, the controller has a plurality of control modes including a bow turning mode in which the first propulsion device generates a forward propulsive force and the second propulsion device generates a reverse propulsive force with the rear ends of the first propulsion device and the second propulsion device located closer to each other than the front ends of the first propulsion device and the second propulsion device. The predetermined load torque increase condition includes a condition such that the controller is in the bow turning mode.

With this arrangement, in the bow turning mode, the controller drives one of the two adjacent propulsion devices (the first propulsion device) forward and drives the other propulsion device (the second propulsion device) in reverse while steering the two adjacent propulsion devices in a V-shaped orientation (in a so-called toe-out orientation). Thus, a moment is applied to the hull to turn the bow of the hull (e.g., at a fixed point) by controlling the steering states of the two propulsion devices in a manner different from the conventional manner. In this case, the water jet generated by the propulsion device (the first propulsion device) driven forward is likely to apply a resistance to the steering of the propulsion device (the second propulsion device) driven in reverse. To cope with this, the propulsive force restricting control is performed in the bow turning mode, thus making it possible to steer the two propulsion devices to their target steering angles to properly turn the bow of the hull.

In a preferred embodiment of the present invention, the second steering device includes an electric motor as its drive source. With this arrangement, the steering device (the second steering device) for the other propulsion device (the second propulsion device) which receives the water jet generated by the one propulsion device (the first propulsion device) includes the electric motor as its drive source. There is a possibility that the steering device (the second steering device) including the electric motor as its drive source cannot steer the corresponding propulsion device (the second propulsion device) to its target steering angle when the steering load torque is great. If the electric motor is stopped due to an excessively great steering load torque, for example, a fail-safe control is performed to prevent the flow of an excessively large drive current. Therefore, where the steering load torque is likely to be excessively increased, the propulsive force restricting control is performed, thus making it possible to properly control the steering angles of the propulsion devices while preventing the electric motor from being overloaded.

In a preferred embodiment of the present invention, the predetermined load torque increase condition includes a steering angle condition such that the second propulsion device receives the water jet generated by the first propulsion device due to a steering angle relationship between the first propulsion device and the second propulsion device.

With this arrangement, the steering load torque is likely to be excessively increased when the other propulsion device (the second propulsion device) receives the water jet from the one propulsion device (the first propulsion device). In this case, the propulsive force restricting control is performed, thus making it possible to steer the propulsion devices to their target steering angles while preventing the steering load torque from being excessively increased.

In a preferred embodiment of the present invention, the second propulsion device includes a rudder plate, and the predetermined load torque increase condition includes a steering angle condition such that the rudder plate receives the water jet generated by the first propulsion device due to a steering angle relationship between the first propulsion device and the second propulsion device.

With this arrangement, the steering load torque is likely to be excessively increased when the rudder plate of the other propulsion device (the second propulsion device) receives the water jet from the one propulsion device (the first propulsion device). In this case, the propulsive force restricting control is performed, thus making it possible to steer the propulsion devices to their target steering angles while preventing the steering load torque from being excessively increased.

In a preferred embodiment of the present invention, at least one of the first propulsion device and the second propulsion device is an electric propulsion device that includes an electric motor as its drive source.

The electric propulsion device tends to be designed so as to have a wider steerable angle range (e.g., ±70 degrees or wider) as compared with an engine propulsion device. Where the two propulsion devices, at least one of which is the electric propulsion device, are adjacent to each other, a water jet generated by the electric propulsion device is more likely to hinder the steering of the other propulsion device. In this case, the propulsive force restricting control is performed, thus making it possible to properly steer the two propulsion devices to their target steering angles.

Another preferred embodiment of the present invention provides a watercraft propulsion system including at least two propulsion devices attachable to a hull in a steerable manner (in a laterally pivotable manner), at least two steering devices to respectively steer the at least two propulsion devices, and a controller configured or programmed to control the at least two propulsion devices and the at least two steering devices, and configured or programmed to include a plurality of control modes including a bow turning mode in which one of the at least two propulsion devices generates a forward propulsive force and another of the at least two propulsion devices generates a reverse propulsive force with the rear ends of the at least two propulsion devices located closer to each other than the front ends of the at least two propulsion devices.

With this arrangement, for example, one of two adjacent propulsion devices is driven forward and the other propulsion device is driven in reverse with the two adjacent propulsion devices steered in a V-shaped orientation (in a so-called toe-out orientation) in the bow turning mode. Thus, a moment is applied to the hull such that the bow of the hull can be turned (e.g., at a fixed point) by controlling the steering states of the two propulsion devices in a manner different from the conventional manner.

Another further preferred embodiment of the present invention provides a watercraft propulsion system including at least two propulsion devices attachable to a hull in a steerable manner (in a laterally pivotable manner), at least two steering devices to respectively steer the at least two propulsion devices, and a controller configured or programmed to control the at least two propulsion devices and the at least two steering devices, and configured or programmed to include a plurality of control modes including a bow turning mode in which the at least two propulsion devices respectively generate propulsive forces tangentially of a circle about the turning center of the hull so as to respectively apply moments to the hull in the same turning direction about the turning center of the hull.

With this arrangement, the plurality of propulsion devices generate the propulsive forces tangentially of the circle about the turning center of the hull in the bow turning mode such that the moments are applied to the hull in the same turning direction. Thus, the bow of the hull can be turned (e.g., at a fixed point) by controlling the steering states of the plurality of propulsion devices in a manner different from the conventional manner.

Still another preferred embodiment of the present invention provides a watercraft including a hull, and a watercraft propulsion system attached to the hull and having any of the above-described features.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
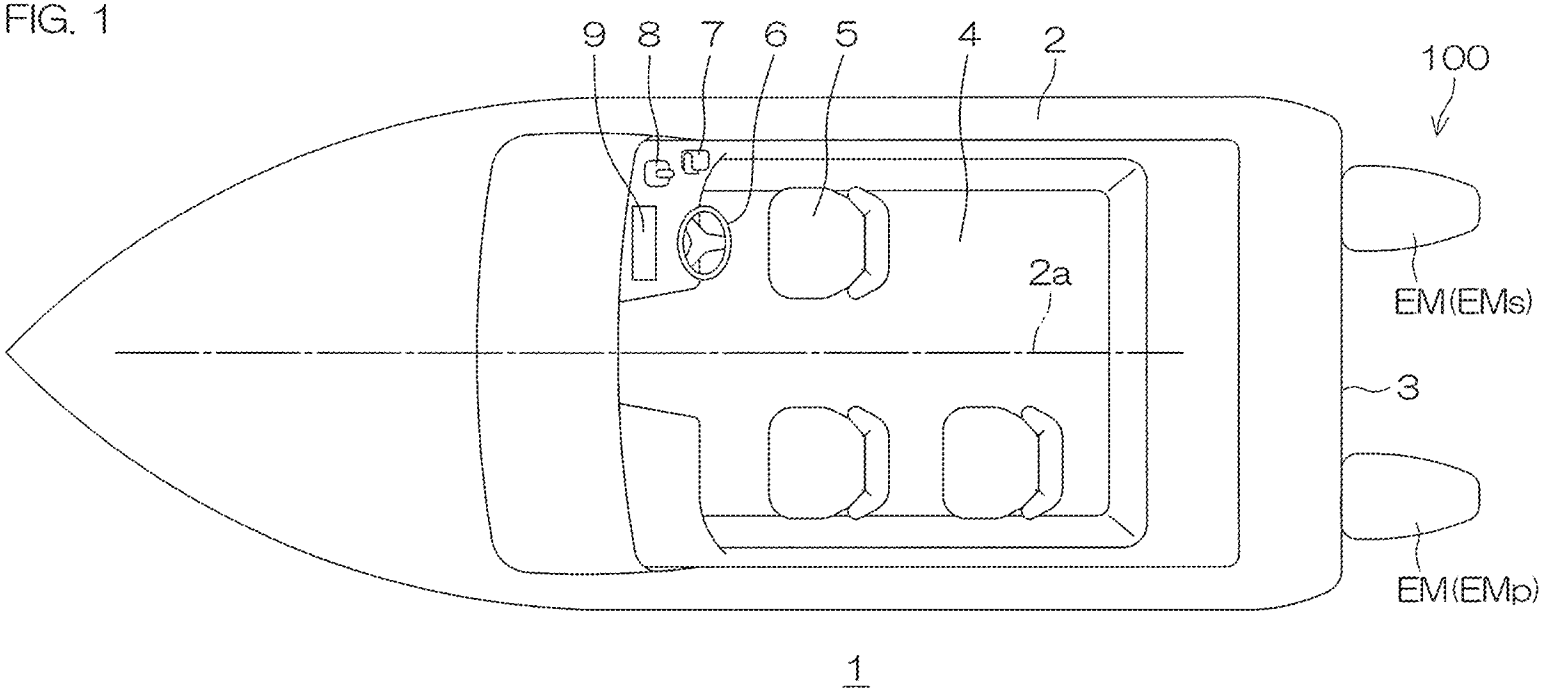
FIG. 1 is a plan view showing an exemplary construction of a watercraft mounted with a watercraft propulsion system according to a preferred embodiment of the present invention.

FIG. 1 is a plan view showing an exemplary construction of a watercraft 1 mounted with a watercraft propulsion system 100 according to a preferred embodiment of the present invention.

The watercraft 1 includes a hull 2, and a plurality of electric outboard motors EM attached to the hull 2. In the present preferred embodiment, two electric outboard motors EM are attached to the hull 2. The electric outboard motors EM are examples of the propulsion devices, more specifically, examples of the electric propulsion device including the electric motor as its power source.

In the present preferred embodiment, the two electric outboard motors EM are attached to the stern 3 of the watercraft 1. More specifically, the two electric outboard motors EM are disposed side by side transversely of the hull 2 in adjacent relation on the stern 3. That is, no other propulsion device is disposed between the two electric outboard motors EM. For discrimination between the two electric outboard motors EM, one of the electric outboard motors EM disposed rightward relative to the other electric outboard motor EM is referred to as "starboard-side electric outboard motor EMs" and the other electric outboard motor EM disposed leftward relative to the one electric outboard motor EM is referred to as "port-side electric outboard motor EMp." In this example, the starboard-side electric outboard motor EMs is disposed on the right side of a center line 2*a* extending anteroposteriorly of the hull 2, and the port-side electric outboard motor EMp is disposed on the left side of the center line 2*a*. More specifically, the starboard-side electric outboard motor EMs and the port-side electric outboard motor EMp are disposed symmetrically with respect to the center line 2*a*.

A usable space 4 for passengers is provided inside the hull 2. A helm seat 5 is provided in the usable space 4. A steering wheel 6, a remote control lever 7, a joystick 8, a gauge 9 (display panel) and the like are provided in association with the helm seat 5. The steering wheel 6 is an operation element operable by an operator to change the course of the watercraft 1. The remote control lever 7 is an operation element operable by the operator to change the magnitudes (outputs) and the directions (forward or reverse directions) of the propulsive forces of the electric outboard motors EM, and corresponds to an acceleration operation element. The joystick 8 is an operation element operable instead of the steering wheel 6 and the remote control lever 7 by the operator for watercraft maneuvering operation.

Figure 2:
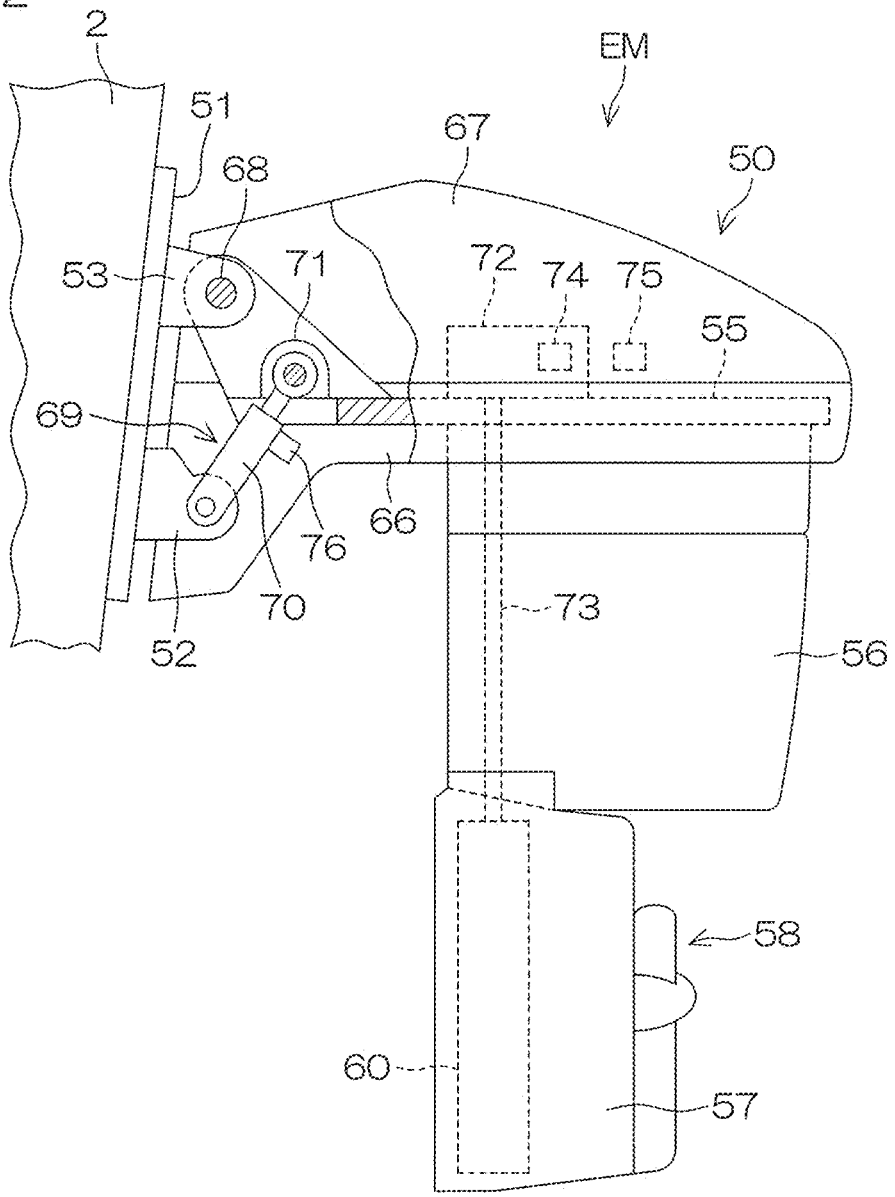
FIG. 2 is a side view showing the structure of an electric outboard motor by way of example.
Figure 3:
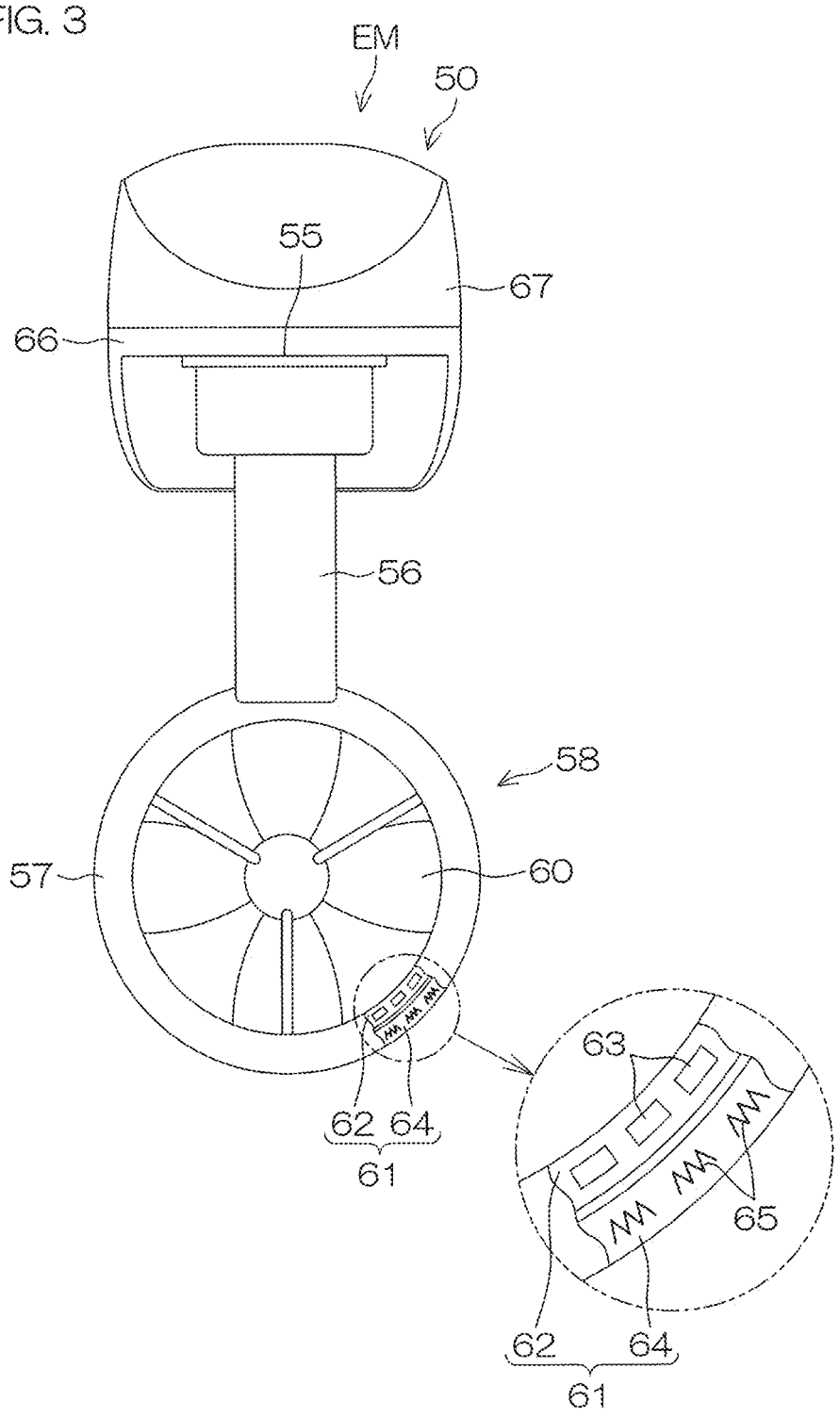
FIG. 3 is a rear view of the electric outboard motor as seen from a rear side of the watercraft.

FIG. 2 is a side view showing the structure of the electric outboard motor EM by way of example, and FIG. 3 is a rear view of the electric outboard motor EM as seen from the rear side of the watercraft 1.

The electric outboard motors EM each include a bracket 51 for attachment thereof to the hull 2, and a propulsion device body 50. The propulsion device body 50 is supported by the bracket 51. The propulsion device body 50 includes a base 55 supported by the bracket 51, an upper housing 56 extending downward from the base 55, a tubular (duct-shaped) lower housing 57 disposed below the upper housing 56, and a drive unit 58 disposed in the lower housing 57. The propulsion device body 50 further includes a cover 66 that covers the base 55 from the lower side, and a cowl 67 that covers the base 55 from the upper side. A tilt unit 69 and a steering unit 72 are accommodated in a space defined by the cover 66 and the cowl 67. Further, a buzzer 75 that generates sound when the tilt unit 69 is actuated may be accommodated in this space.

The drive unit 58 includes a propeller 60, and an electric motor 61 that rotates the propeller 60. The electric motor 61 includes a tubular rotor 62 to which the propeller 60 is fixed radially inward thereof, and a tubular stator 64 that surrounds the rotor 62 from the radially outside. The stator 64 is fixed to the lower housing 57, and the rotor 62 is supported rotatably with respect to the lower housing 57. The rotor 62 includes a plurality of permanent magnets 63 disposed circumferentially thereof. The stator 64 includes a plurality of coils 65 disposed circumferentially thereof. The rotor 62 is rotated by energizing the coils 65 such that the propeller 60 is correspondingly rotated to generate a propulsive force.

The tilt unit 69 includes a tilt cylinder 70 as a tilt actuator. The tilt cylinder 70 may be a hydraulic cylinder of electric pump type adapted to pump a hydraulic oil by an electric pump. One of opposite ends of the tilt cylinder 70 is connected to the lower support portion 52 of the bracket 51, and the other end of the tilt cylinder 70 is connected to the base 55 via a cylinder connection bracket 71. A tilt shaft 68 is supported by the upper support portion 53 of the bracket 51, and the base 55 is connected to the bracket 51 via the tilt shaft 68 pivotally about the tilt shaft 68. The tilt shaft 68 extends transversely of the hull 2, so that the base 55 is pivotable upward and downward. Thus, the propulsion device body 50 is pivotable upward and downward about the tilt shaft 68.

An expression "tilt-up" means that the propulsion device body 50 is pivoted upward about the tilt shaft 68, and an expression "tilt-down" means that the propulsion device body 50 is pivoted downward about the tilt shaft 68. The tilt cylinder 70 is driven to be extended and retracted such that the tilt-up and the tilt-down is achieved. The propeller 60 is moved up to an above-water position by the tilt-up such that the propulsion device body 50 is brought into a tilt-up state. Further, the propeller 60 is moved down to an underwater position by the tilt-down such that the propulsion device body 50 is brought into a tilt-down state. The tilt unit 69 is an exemplary lift device that moves up and down the propeller 60.

A tilt angle sensor 76 is provided to detect a tilt angle (i.e., the angle of the propulsion device body 50 with respect to the bracket 51) to detect the tilt-up state and the tilt-down state of the propulsion device body 50. The tilt angle sensor 76 may be a position sensor that detects the position of the actuation rod of the tilt cylinder 70.

The steering unit 72 includes a steering shaft 73 connected to the lower housing 57 and the upper housing 56, and a steering actuator 74. The steering actuator 74 generates a drive force to pivot the steering shaft 73 about its axis. Therefore, the lower housing 57 and the upper housing 56 are pivoted about the steering shaft 73 by driving the steering actuator 74 such that the direction of the propulsive force generated by the drive unit 58 is changeable leftward and rightward. The upper housing 56 has a plate shape that extends anteroposteriorly of the hull 2 in a neutral steering position, and functions as a rudder plate to be steered by the steering unit 72. The steering unit 72 is an example of the steering device. In this example, the steering unit 72 is incorporated unitarily with the propulsion device body 50 in the electric outboard motor EM, but the steering device is not necessarily required to be incorporated in the electric outboard motor.

Figure 4:
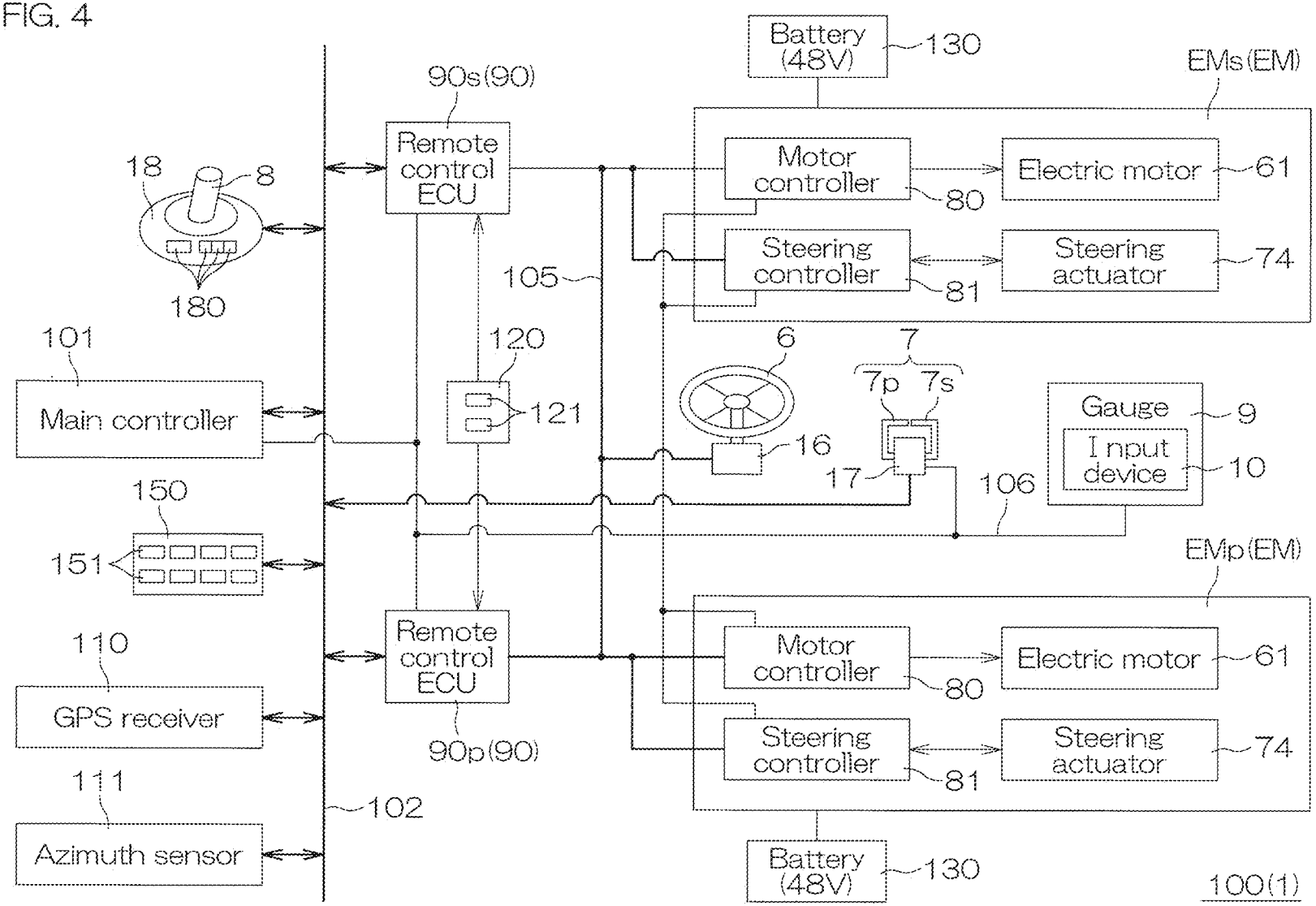
FIG. 4 is a block diagram showing the configuration of the watercraft propulsion system by way of example.

FIG. 4 is a block diagram showing an exemplary configuration of the watercraft propulsion system 100 provided in the watercraft 1. The watercraft propulsion system 100 includes the two electric outboard motors EM (EMs, EMp).

The watercraft propulsion system 100 includes a main controller 101. The main controller 101 is connected to an onboard network 102 (CAN: Control Area Network) provided in the hull 2. Remote control ECUs 90 (90*s*, 90*p*) respectively associated with the two electric outboard motors EM (EMs, EMp), a joystick unit 18, a GPS (Global Positioning System) receiver 110, an azimuth sensor 111, and the like are connected to the onboard network 102. The electric outboard motors EM each include a motor controller 80 and a steering controller 81, which are connected to the associated remote control ECU 90 via an outboard motor control network 105. The main controller 101 transmits and receives signals to/from various units connected to the onboard network 102 to control the electric outboard motors EM, and further controls other units. The main controller 101 has a plurality of control modes, and controls the units in predetermined manners according to the respective control modes.

A steering wheel unit 16 is connected to the outboard motor control network 105. The steering wheel unit 16 outputs an operation angle signal indicating the operation angle of the steering wheel 6 to the outboard motor control network 105. The operation angle signal is received by the remote control ECUs 90 and the steering controllers 81. In response to the operation angle signal generated by the steering wheel unit 16 or steering angle commands respectively generated by the remote control ECUs 90, the steering controllers 81 of the electric outboard motors EM respectively control the steering actuators 74 to control the steering angles of the electric outboard motors EM.

A remote control unit 17, which generates an operation position signal indicating the operation position of the remote control lever 7, is connected to the onboard network 102. The remote control unit 17 includes a starboard-side remote control lever 7*s* and a port-side remote control lever 7*p* respectively associated with the starboard-side electric outboard motor EMs and the port-side electric outboard motor EMp. The remote control unit 17 outputs the operation position signal indicating the operation position of the remote control lever 7 to the onboard network 102. The operation position signal is received by the remote control ECUs 90. The remote control ECUs 90 each generate a propulsive force command. In response to the propulsive force command, the motor controller 80 controls the electric motor 61 to control the propulsive force of the electric outboard motor EM.

The joystick unit 18 generates an operation position signal indicating the operation position of the joystick 8, and generates an operation signal indicating the operation of any of operation buttons 180 provided in the joystick unit 18.

The remote control ECUs 90 are each able to output the propulsive force command to the corresponding motor controller 80 via the outboard motor control network 105. The propulsive force command includes a shift command for forward drive, reverse drive or stop, and an output command for an output (specifically, a motor rotation speed). Further, the remote control ECUs 90 are each able to output the steering angle command to the corresponding steering controller 81 via the outboard motor control network 105.

The remote control ECUs 90 each perform different control operations according to different control modes of the main controller 101. In a control mode for watercraft maneuvering with the use of the steering wheel 6 and the remote control lever 7, for example, the remote control ECUs 90 each generate the propulsive force command according to the operation position signal generated by the remote control unit 17, and each apply the propulsive force command to the corresponding motor controller 80. Further, the remote control ECUs 90 each command the corresponding steering controller 81 to conform to the operation angle signal generated by the steering wheel unit 16. In a control mode for watercraft maneuvering without the use of the steering wheel 6 and the remote control lever 7, on the other hand, the remote control ECUs 90 each conform to commands applied by the main controller 101. That is, the main controller 101 generates the propulsive force command (the shift command and the output command) and the steering angle command, and the remote control ECUs 90 each output the propulsive force command (the shift command and the output command) and the steering angle command to the motor controller 80 and the steering controller 81, respectively. In a control mode for watercraft maneuvering with the use of the joystick 8, for example, the main controller 101 generates the propulsive force command (the shift command and the output command) and the steering angle command according to the signals generated by the joystick unit 18. The magnitude and the direction (the forward direction or the reverse direction) of the propulsive force and the steering angle of each of the electric outboard motors EM are controlled according to the propulsive force command (the shift command and the output command) and the steering angle command thus generated.

The motor controller 80 and the steering controller 81 of each of the electric outboard motors EM are configured to actuate the electric outboard motor EM in response to the propulsive force command and the steering angle command applied from the corresponding remote control ECU 90. As described above, the propulsive force command includes the shift command and the output command. The shift command is a rotation direction command for the stop, the forward rotation, or the reverse rotation of the propeller 60. The output command is a command for the magnitude of the propulsive force to be generated, specifically, a command for the rotation speed. The steering angle command is a command for the steering angle. The motor controller 80 controls the electric motor 61 according to the shift command (rotation direction command) and the output command. Further, the steering controller 81 controls the steering actuator 74 according to the steering angle command.

The GPS receiver 110 detects the position of the watercraft 1 by receiving radio waves from an artificial satellite orbiting the earth, and outputs position data indicating the position of the watercraft 1 and speed data indicating the moving speed of the watercraft 1. The main controller 101 acquires the position data and the speed data, which are used to control and display the position and/or the azimuth of the watercraft 1.

The azimuth sensor 111 detects the azimuth of the watercraft 1, and generates azimuth data, which is used by the main controller 101.

The gauge 9 is connected to the main controller 101 via a control panel network 106. The gauge 9 is a display device that displays various information for the watercraft maneuvering. The gauge 9 is connected to the remote control ECUs 90, and to the motor controllers 80 and the steering controllers 81 of the electric outboard motors EM via the control panel network 106. Thus, the gauge 9 can display information such as the operation states of the electric outboard motors EM, and the position and/or the azimuth of the watercraft 1. The gauge 9 may include an input device 10 such as a touch panel and buttons. The input device 10 may be operated by the operator to set various settings and give various commands such that operation signals are outputted to the control panel network 106.

A power switch unit 120 operable to turn on and off power supplies to the electric outboard motors EM is connected to the remote control ECUs 90. The power switch unit 120 includes a plurality of power switches 121 (two power switches 121 in the present preferred embodiment) operable to separately turn on and off the starboard-side electric outboard motor EMs and the port-side electric outboard motor EMp.

With the power switches 121 turned on, the remote control ECUs 90 perform a power supply control to control the power supplies to the respective electric outboard motors EM. Specifically, power supply relays (not shown) respectively provided between batteries 130 (e.g., 48 V) and the electric outboard motors EM are turned on. The batteries 130 preferably include a plurality of batteries 130 (two batteries 130 in the present preferred embodiment) respectively provided in association with the electric outboard motors EM. When the power switches 121 are turned off, the remote control ECUs 90 respectively turn off the power supply relays to turn off the power supplies to the electric outboard motors EM. Electric outboard motor state information indicating whether or not the power supplies to the respective electric outboard motors EM are turned on is applied from the remote control ECUs 90 to the main controller 101 via the onboard network 102.

An application switch panel 150 is further connected to the onboard network 102. The application switch panel 150 includes a plurality of function switches 151 operable to apply predefined function commands. For example, the function switches 151 may include switches for automatic watercraft maneuvering commands. Specific examples of the function switches 151 may include switches for an automatic steering function of maintaining the azimuth of the watercraft 1, for an automatic steering function of maintaining the course of the watercraft 1, for an automatic steering function of causing the watercraft 1 to pass through a plurality of checkpoints sequentially, and for an automatic steering function of causing the watercraft 1 to sail along a predetermined pattern (zig-zag pattern, spiral pattern or the like). A function for the tilt-up or the tilt-down of the electric outboard motors EM may be assigned to one of the function switches 151.

The main controller 101 is able to control the electric outboard motors EM in the plurality of control modes. The control mode of the main controller 101 can be classified into an ordinary mode, a joystick mode, or a holding mode in terms of operation system.

In the ordinary mode, a steering control operation is performed according to the operation angle signal generated by the steering wheel unit 16, and a propulsive force control operation is performed according to the operation signal (operation position signal) of the remote control lever 7. In the present preferred embodiment, the ordinary mode is a default control mode of the main controller 101. In the steering control operation, specifically, the steering controllers 81 of the electric outboard motors EM respectively drive the steering actuators 74 according to the operation angle signal generated by the steering wheel unit 16 or the steering angle commands generated by the remote control ECUs 90. Thus, the drive units 58 and the upper housings 56 of the electric outboard motors EM are steered leftward and rightward such that the propulsive force directions of the electric outboard motors EM are changed leftward and rightward with respect to the hull 2. In the propulsive force control operation, specifically, the motor controllers 80 of the electric outboard motors EM respectively drive the electric motors 61 according to the propulsive force commands (the shift commands and the output commands) applied from the remote control ECUs 90 to the motor controllers 80. Thus, the electric motors 61 are each controlled to a forward rotation state, a reverse rotation state, or a stop state, and the rotation speeds of the electric motors 61 are changed.

In the joystick mode, the steering control operation and the propulsive force control operation are performed according to the operation signal of the joystick 8 of the joystick unit 18. The holding mode includes automatic watercraft maneuvering modes that are selectable by operating holding mode setting buttons 182, 183, 184 (see FIG. 5) provided in the joystick unit 18 to perform the steering control operation and the propulsive force control operation so as to hold the position and/or the azimuth of the hull 2.

Figure 5:
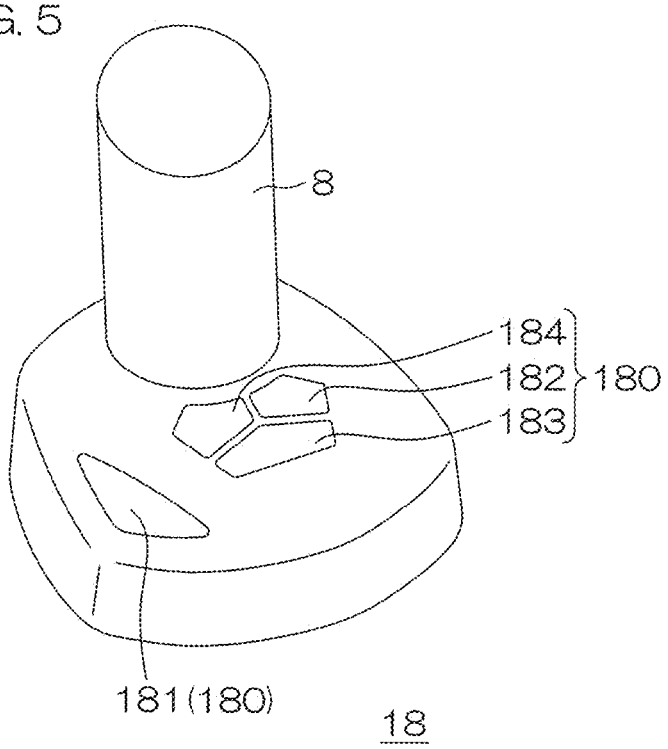
FIG. 5 is a perspective view showing the structure of a joystick unit by way of example.

FIG. 5 is a perspective view showing the structure of the joystick unit 18 by way of example. The joystick unit 18 includes the joystick 8, which is inclinable forward, backward, leftward, and rightward (i.e., in all 360-degree directions) and is pivotable (twistable) about its axis. In this example, the joystick unit 18 further includes a plurality of operation buttons 180. The operation buttons 180 include a joystick button 181 and the holding mode setting buttons 182 to 184.

The joystick button 181 is an operation element operable by the operator to select the control mode (watercraft maneuvering mode) utilizing the joystick 8, i.e., the joystick mode.

The holding mode setting buttons 182, 183, 184 are operation buttons operable by the operator to select position/azimuth holding system control modes (examples of the holding mode). More specifically, the holding mode setting button 182 is operated to select a fixed point holding mode (Stay Point™) in which the position and the bow azimuth (or the stern azimuth) of the watercraft 1 are maintained. The holding mode setting button 183 is operated to select a position holding mode (Fish Point™) in which the position of the watercraft 1 is maintained but the bow azimuth (or the stern azimuth) of the watercraft 1 is not maintained. The holding mode setting button 184 is operated to select an azimuth holding mode (Drift Point™) in which the bow azimuth (or the stern azimuth) of the watercraft 1 is maintained but the position of the watercraft 1 is not maintained.

In the joystick mode, the main controller 101 applies the steering angle command and the propulsive force command to the remote control ECUs 90. The remote control ECUs 90 apply the steering angle command to the corresponding steering controllers 81, and apply the propulsive force command to the corresponding motor controllers 80. Thus, the steering control operation and the propulsive force control operation are performed on the electric outboard motors EM. In the steering control operation on the electric outboard motors EM, in this case, the steering controllers 81 of the electric outboard motors EM respectively drive the steering units 72 according to the steering angle command applied from the main controller 101 to the steering controllers 81 via the remote control ECUs 90. Thus, the drive units 58 and the upper housings 56 of the electric outboard motors EM are pivoted leftward and rightward such that the propulsive force directions of the electric outboard motors EM are changed leftward and rightward with respect to the hull 2. In the propulsive force control operation on the electric outboard motors EM, in this case, the motor controllers 80 of the electric outboard motors EM control the rotation directions and the rotation speeds of the electric motors 61 according to the propulsive force command (the shift command and the output command) applied from the main controller 101 to the motor controllers 80 of the electric outboard motors EM via the remote control ECUs 90. Thus, the rotation directions of the propellers 60 are each set to a forward drive direction or a reverse drive direction, and the rotation speeds of the propellers 60 are changed.

Figure 6A:
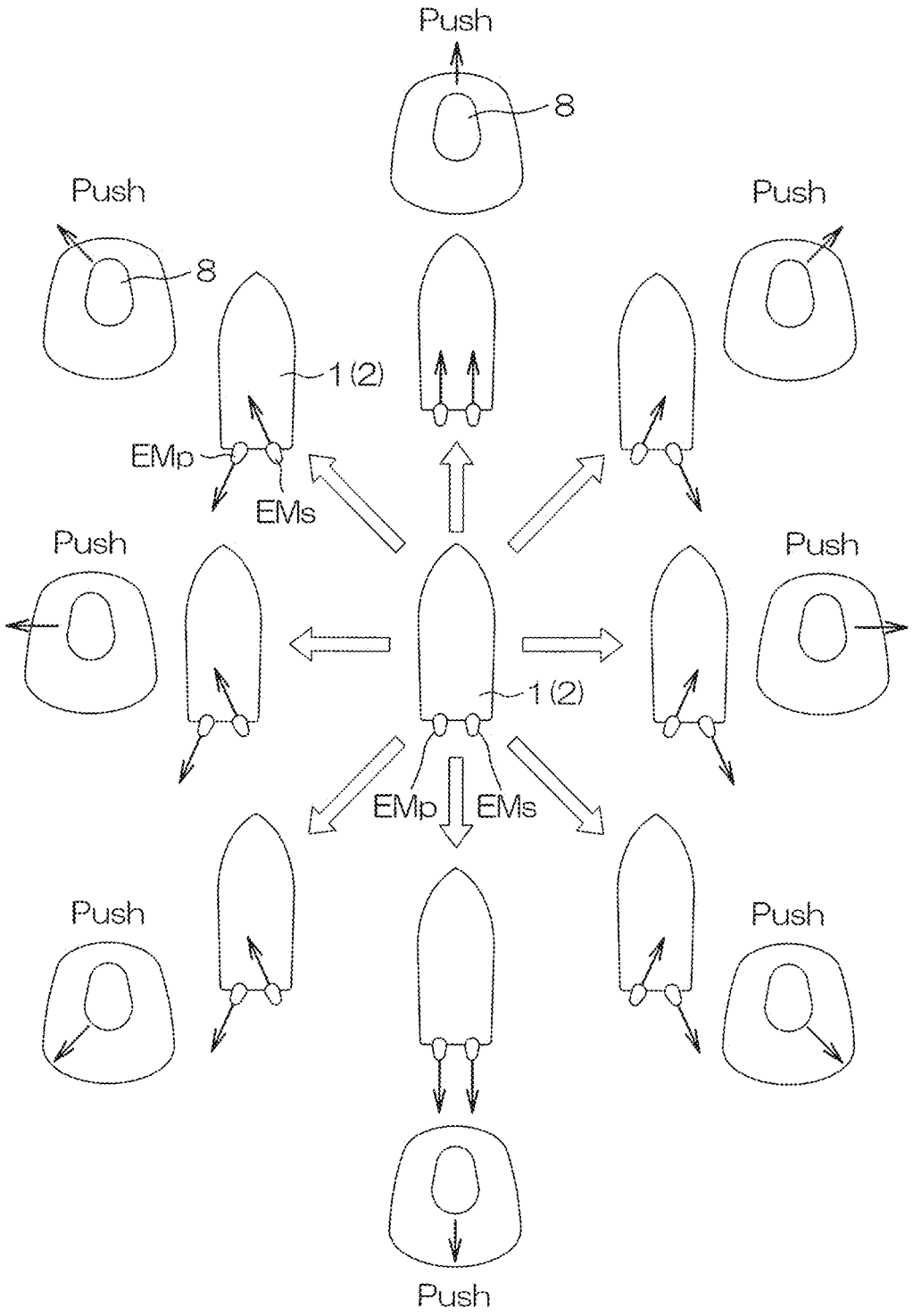
FIGS. 6A and 6B are diagrams for describing a first joystick mode (dual mode), and showing joystick operation states and corresponding hull behaviors (in a translation mode).
Figure 6B:
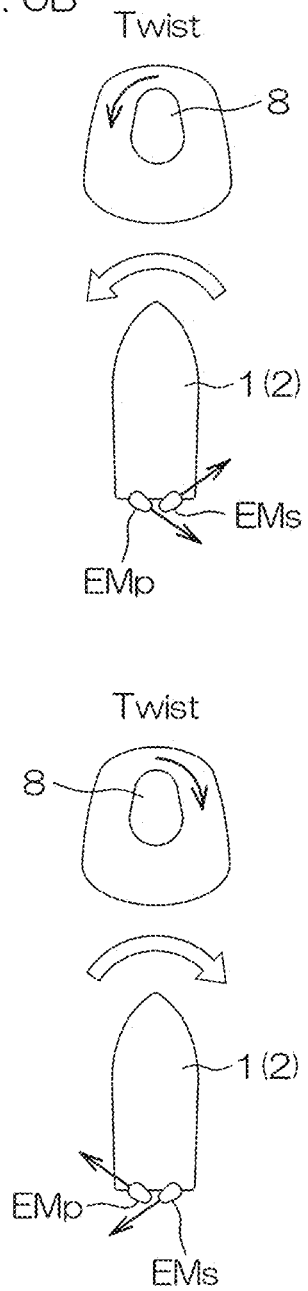
Figure 7A:
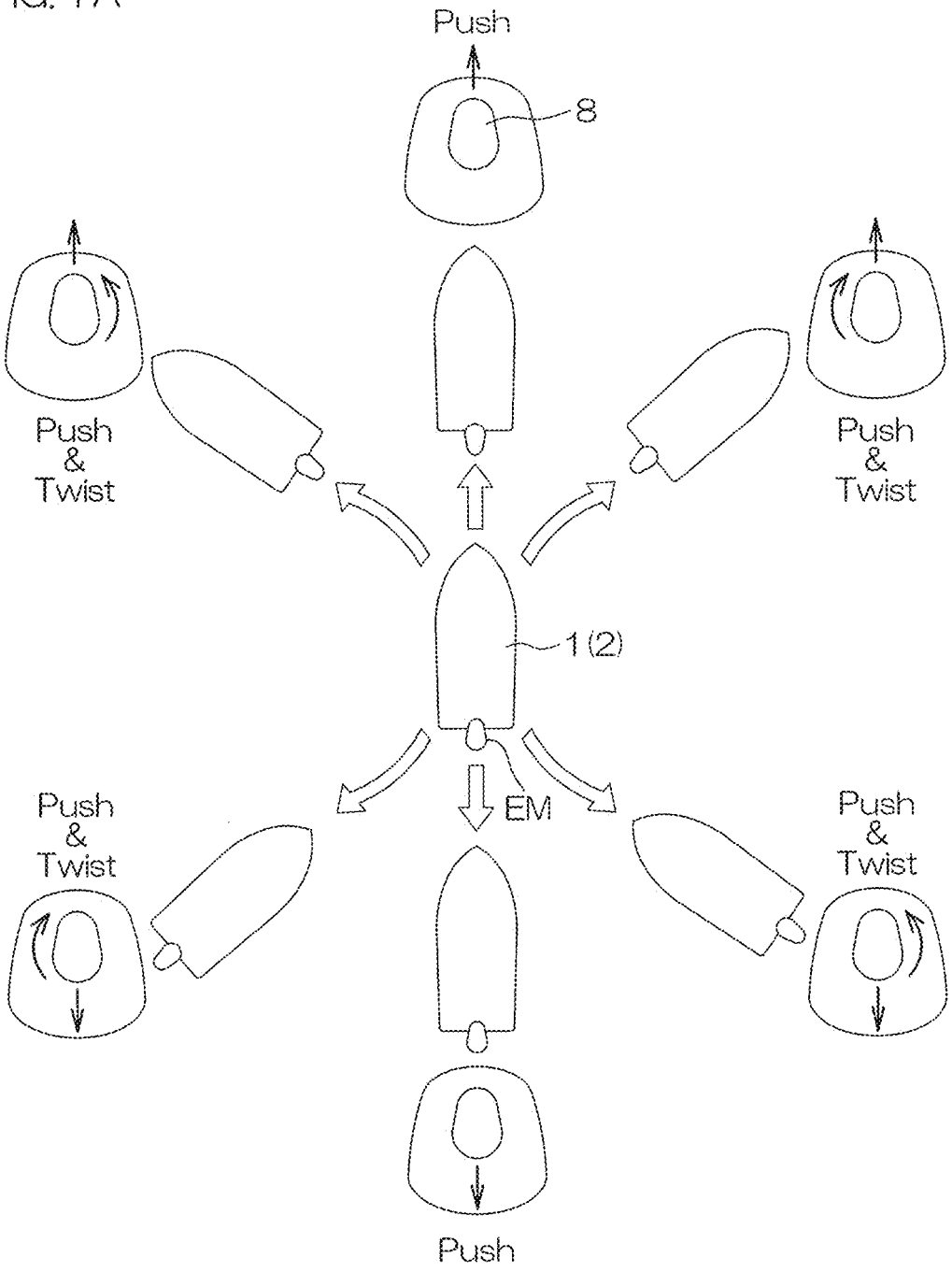
FIGS. 7A and 7B are diagrams for describing a second joystick mode (single mode), and showing joystick operation states and corresponding hull behaviors.
Figure 7B:
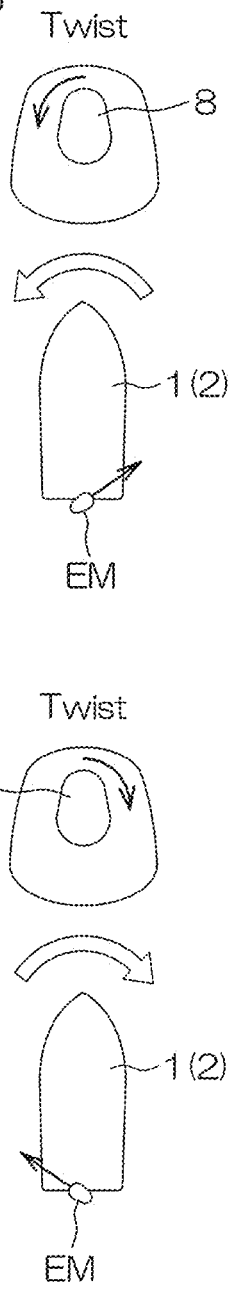

FIGS. 6A, 6B, 7A, and 7B are diagrams for describing two types of joystick modes, showing the operation states of the joystick 8 and the corresponding behaviors of the hull 2. More specifically, FIGS. 6A and 6B show exemplary operations to be performed in a first joystick mode in which the propulsive forces of the two electric outboard motors EM are both utilized. FIGS. 7A and 7B show exemplary operations to be performed in a second joystick mode in which only one of the propulsive forces of the two electric outboard motors EM is utilized.

Based on the electric outboard motor state information, the main controller 101 detects whether the power supply mode is a dual mode in which the power supplies to the two electric outboard motors EM are both turned on or a single mode in which the power supply to only one of the two electric outboard motors EM is turned on. If the joystick mode is commanded by operating the joystick button 181 in the dual mode, the main controller 101 performs the control operation according to the first joystick mode. If the joystick mode is commanded by operating the joystick button 181 in the single mode, the main controller 101 performs the control operation according to the second joystick mode.

In the first joystick mode shown in FIGS. 6A and 6B, the main controller 101 defines the inclination direction of the joystick 8 as an advancing direction command, and defines the inclination amount of the joystick 8 as a propulsive force magnitude command that indicates the magnitude of the propulsive force to be applied in the inclination direction. Further, the main controller 101 defines the pivoting direction of the joystick 8 about its axis (with respect to the neutral position of the joystick 8) as a bow turning direction command, and defines the pivoting amount of the joystick 8 (with respect to the neutral position of the joystick 8) as a bow turning speed command. For execution of these commands, the steering angle command and the propulsive force command are generated by the main controller 101 and applied to the steering controllers 81 and the motor controllers 80 of the electric outboard motors EM via the remote control ECUs 90. Thus, the drive units 58 and the upper housings 56 of the respective electric outboard motors EM are steered to the steering angles according to the steering command, and the rotation directions and the rotation speeds of the electric motors 61 of the respective electric outboard motors EM are controlled so as to generate the propulsive forces according to the propulsive force command.

When the joystick 8 is inclined without being pivoted in the first joystick mode, the hull 2 is moved in a direction corresponding to the inclination direction of the joystick 8 without the bow turning, i.e., with its azimuth maintained. That is, the hull 2 is in a hull translation behavior. Examples of the hull translation behavior are shown in FIG. 6A. The steering states of the two electric outboard motors EM are typically such that the propulsive force action lines of the two electric outboard motors EM (extending along the respective propulsive force directions) cross each other in the hull 2. That is, the two electric outboard motors EM are steered in an inverted V-shaped orientation as seen in plan (in a so-called toe-in orientation). With the electric outboard motors EM thus steered, one of the electric outboard motors EM is driven forward, and the other electric outboard motor EM is driven in reverse. Thus, the hull 2 translates in the direction of the resultant force of the propulsive forces generated by the two electric outboard motors EM. Where one of the electric outboard motors EM is driven forward and the other electric outboard motor EM is driven in reverse to generate propulsive forces of the same magnitude, for example, the hull 2 can translate laterally. The control mode of the main controller 101 in which the two electric outboard motors EM are controlled in the above-described manner to translate the hull 2 in the first joystick mode is referred to as "translation mode."

When the joystick 8 is inclined and pivoted in the first joystick mode, the hull 2 is in a hull behavior such that the bow is turned in a direction corresponding to the pivoting direction of the joystick 8 while the hull 2 is moved in a direction corresponding to the inclination direction of the joystick 8. At this time, a moment is applied to the hull 2 by changing the steering angles and/or the outputs of the two electric outboard motors EM while keeping the inverted V-shaped orientation steering states of the two electric outboard motors EM. In this case, therefore, the control mode of the main controller 101 is the translation mode.

When the joystick 8 is pivoted (twisted) without being inclined in the first joystick mode, on the other hand, the bow of the hull 2 is turned in a direction corresponding to the pivoting direction of the joystick 8 without any substantial position change. That is, the hull 2 is in a fixed-point bow turning behavior. Examples of the fixed-point bow turning behavior are shown in FIG. 6B. In these examples, the steering states of the two electric outboard motors EM in the fixed-point bow turning behavior are such that the propulsive force action lines of the two electric outboard motors EM (extending along the respective propulsive force directions) cross each other behind the hull 2. That is, the two electric outboard motors EM are steered in a V-shaped orientation as seen in plan (in a so-called toe-out orientation). With the electric outboard motors EM thus steered, one of the electric outboard motors EM is driven forward, and the other electric outboard motor EM is driven in reverse. Thus, the propulsive forces respectively generated by the two electric outboard motors EM each apply a moment to the hull 2 about the turning center of the hull 2 such that the hull 2 is brought into the fixed-point bow turning behavior. The control mode of the main controller 101 in which the two electric outboard motors EM are controlled in the above-described manner to turn the bow of the hull 2 in the first joystick mode is referred to as "bow turning mode."

In the second joystick mode shown in FIGS. 7A and 7B, the propulsive force generated by only one of the two electric outboard motors EM is utilized and, therefore, the hull translation (see FIG. 6A) which utilizes the resultant force of the propulsive forces of the two electric outboard motors EM is impossible as shown in FIG. 7A. That is, the second joystick mode is a control mode that disables a certain hull behavior (specifically, the hull translation behavior) available in the first joystick mode. As shown in FIG. 7B, the propulsive force generated by only one of the electric outboard motors EM can apply the moment to the hull 2 about the turning center, so that the fixed-point bow turning behavior may be available.

In the second joystick mode, the main controller 101 defines the anteroposterior inclination of the joystick 8 as the propulsive force command (the shift command and the output command), and ignores the lateral inclination of the joystick 8. That is, when the joystick 8 is inclined, only the anteroposterior directional component of the inclination direction of the joystick 8 serves as an effective input, and is defined as the propulsive force command. More specifically, if the anteroposterior directional component has a value indicating the forward inclination, the anteroposterior directional component is defined as a forward shift command. If the anteroposterior directional component has a value indicating the rearward inclination, the anteroposterior directional component is defined as a reverse shift command. Further, the magnitude of the anteroposterior directional component is defined as a command (output command) indicating the magnitude of the propulsive force. The propulsive force command (the shift command and the output command) thus defined is inputted from the main controller 101 to the motor controller 80 of the one electric outboard motor EM via the corresponding remote control ECU 90. On the other hand, the main controller 101 defines the axial pivoting of the joystick 8 as the steering angle command in the second joystick mode. That is, the main controller 101 generates the steering angle command according to the axial pivoting direction and the axial pivoting amount of the joystick 8, and inputs the steering angle command to the steering controller 81 of the one electric outboard motor EM via the corresponding remote control ECU 90. When the joystick 8 is pivoted but not inclined, the main controller 101 may control the steering state of the one electric outboard motor EM in the bow turning mode (see FIG. 7B).

The motor controller 80 drives the corresponding electric motor 61 according to the propulsive force command, and the steering controller 81 drives the corresponding steering actuator 74 according to the steering angle command.

Figure 8:
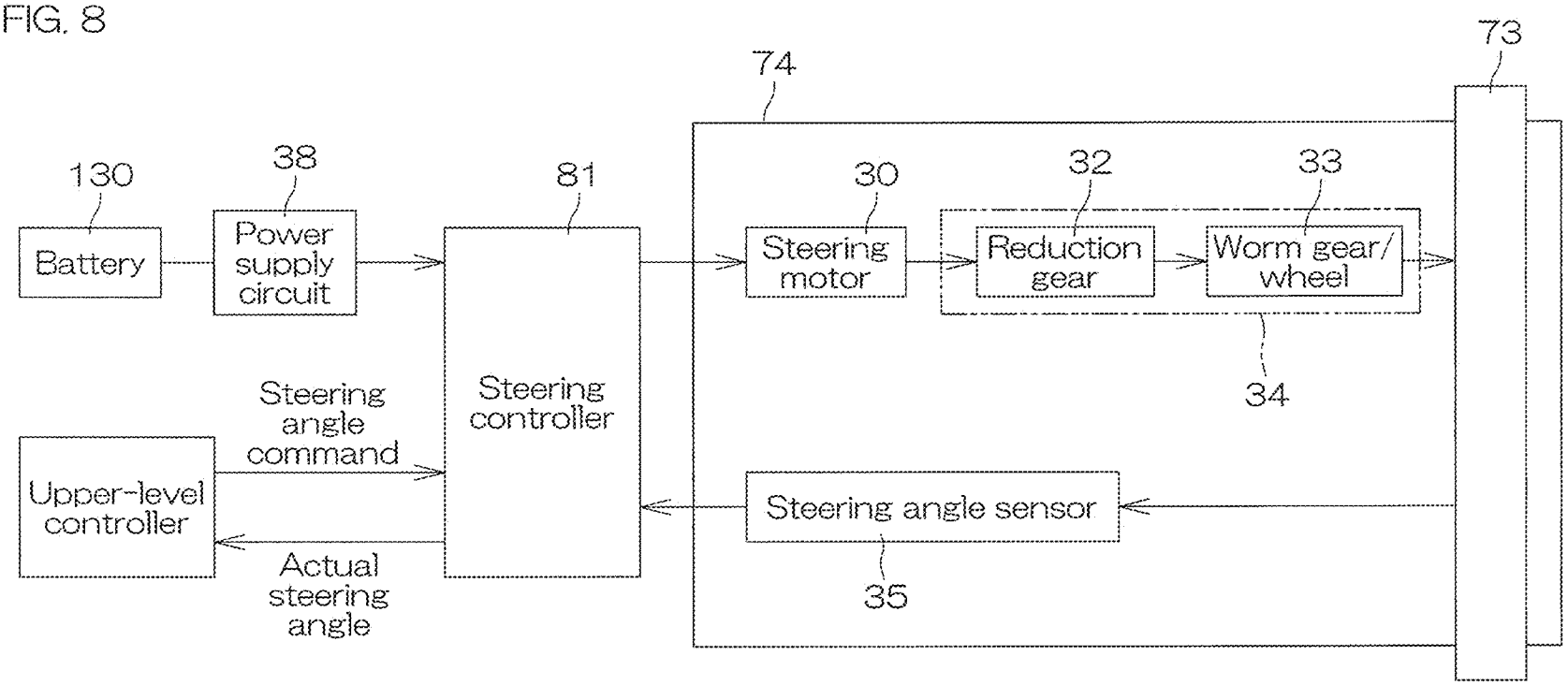
FIG. 8 is a block diagram showing the configuration of a steering actuator.

FIG. 8 is a block diagram showing the configuration of the steering actuator 74. The steering actuator 74 includes a steering motor 30 (an electric motor for the steering). A current is supplied to the steering controller 81 to drive the steering motor 30. A torque generated by the steering motor 30 is transmitted the steering shaft 73 (output shaft) via a deceleration mechanism 34 including a reduction gear 32 and a worm gear/wheel 33. Thus, the steering motor 30 is driven to rotate the steering shaft 73 such that the electric outboard motor EM is steered. The rotation angle of the steering shaft 73 is detected as an actual steering angle by a steering angle sensor 35, and the output signal of the steering angle sensor 35 is inputted to the steering controller 81.

Electric power is supplied from the battery 130 to the steering controller 81 via a power supply circuit 38. The steering angle command is applied from an upper-level controller to the steering controller 81. The upper-level controller is the steering wheel unit 16 in the ordinary mode, and is the remote control ECU 90 in the joystick mode and the holding mode. The steering controller 81 controls a drive current to be supplied to the steering motor 30 through feed-back control so that the actual steering angle detected by the steering angle sensor 35 matches with the value of the steering angle command (steering angle command value). Further, the steering controller 81 applies information of the actual steering angle detected by the steering angle sensor 35 to the upper-level controller.

Figure 9:
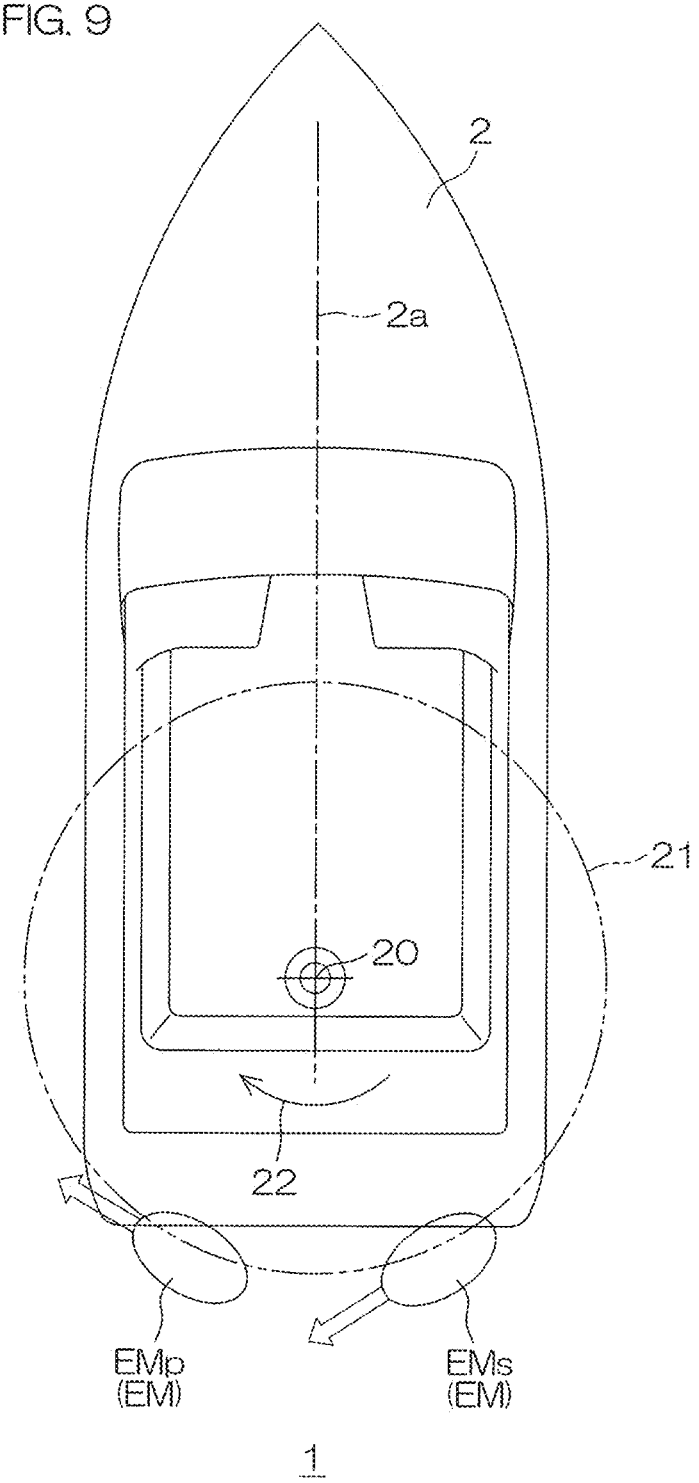
FIG. 9 is a schematic plan view for describing, in greater detail, steering states (see FIG. 6B) in a bow turning mode effected in the dual mode.

FIG. 9 is a schematic plan view for describing, in greater detail, the steering states (see FIG. 6B) in the bow turning mode effected in the dual mode. In the bow turning mode, the main controller 101 controls the steering states of the two electric outboard motors EM so that the rear ends of the electric outboard motors EM are located closer to each other than the front ends of the electric outboard motors EM. That is, as seen in plan, the two electric outboard motors EM are steered in the V-shaped orientation (i.e., the so-called toe-out orientation). At this time, the two electric outboard motors EM respectively generate the propulsive forces generally tangentially of a circle 21 about the turning center 20 of the hull 2. In the bow turning mode, the main controller 101 generates the propulsive force command so as to drive one of the two electric outboard motors EM forward and drive the other electric outboard motor EM reverse. Thus, the two electric outboard motors EM respectively generate the propulsive forces generally tangentially of the circle 21 about the turning center 20 so as to apply moments to the hull 2 in the same turning direction 22 (clockwise in FIG. 9) about the turning center 20. In the example of FIG. 9, the starboard-side electric outboard motor EMs is driven in reverse, and the port-side electric outboard motor EMp is driven forward such that the two electric outboard motors EM apply clockwise moments to the hull 2 about the turning center 20 of the hull 2.

The target steering angles of the electric outboard motors EM in the bow turning mode are hereinafter each referred to as "bow turning mode steering angle." The bow turning mode steering angle of the starboard-side electric outboard motor EMs and the bow turning mode steering angle of the port-side electric outboard motor EMp are respectively referred to as "bow turning mode starboard-side steering angle" and "bow turning mode port-side steering angle" for discrimination therebetween. The steering angles may be each defined with respect to the propulsive force directions parallel or substantially parallel to the anteroposterior direction of the hull 2 with the electric outboard motors EM each set in the neutral steering position. Where the steering angles of the electric outboard motors EM are each defined as zero degrees when the electric outboard motors EM are each set in the neutral steering position, the bow turning mode starboard-side steering angle and the bow turning mode port-side steering angle have different signs and substantially the same absolute value.

The electric outboard motors EM can be more easily designed so as to have a wider steerable angle range as compared with an engine outboard motor employing an engine as its drive source. Specifically, the electric outboard motors EM can be each designed to have a steerable angle range of ±70 degrees or wider (e.g., ±90 degrees), and can be designed even so as to have a steerable angle range of ±180 degrees.

Figure 10:
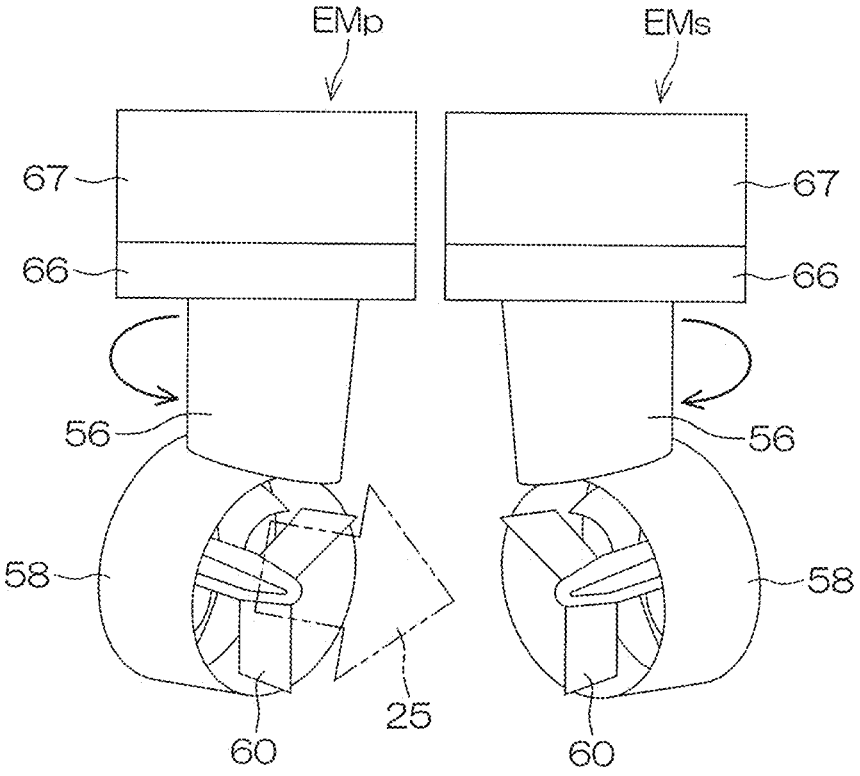
FIG. 10 is a perspective view showing a positional relationship between two electric outboard motors in the bow turning mode.

FIG. 10 is a perspective view showing a positional relationship between the two electric outboard motors EM in the bow turning mode. With the port-side electric outboard motor EMp driven forward, the propeller 60 discharges water from the front side to the rear side such that water jet 25 is generated rearward of the port-side electric outboard motor EMp. Where the electric outboard motors EM are steered in the V-shaped orientation (in the so-called toe-out orientation) in the bow turning mode, at least a portion of the water jet 25 hits the starboard-side electric outboard motor EMs to apply a counterclockwise moment to the starboard-side electric outboard motor EMs. Particularly, when the water jet hits the upper housing 56 (rudder plate) of the starboard-side electric outboard motor EMs, the moment has a relatively great magnitude. Therefore, the steering load torque received by the steering actuator 74 of the starboard-side electric outboard motor EMs is increased by the influence of the water jet 25.

Figure 11:
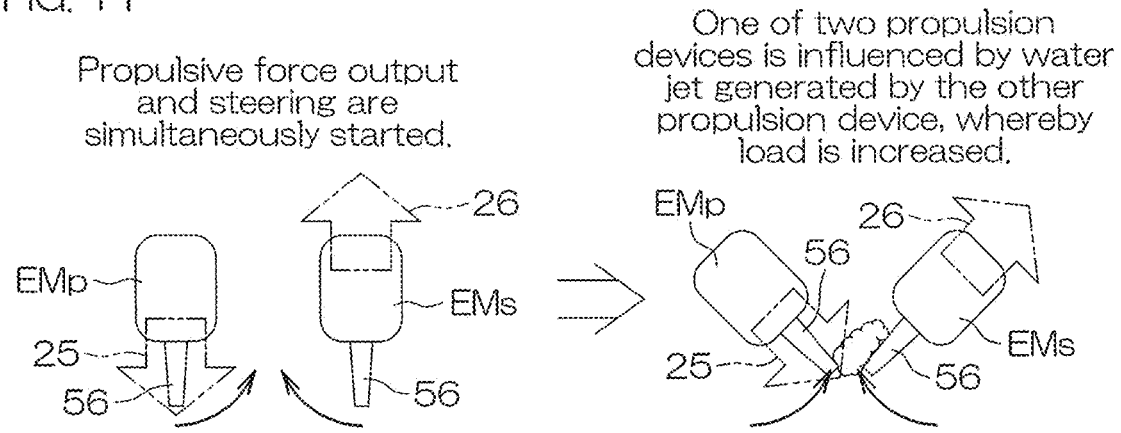
FIG. 11 shows an exemplary operation to be performed at the start of the bow turning mode (according to a comparative example).

FIG. 11 shows an exemplary operation to be performed at the start of the bow turning mode (according to a comparative example). In this example, the two electric outboard motors EM are each set in the neutral steering position with their propulsive force directions parallel or substantially parallel to the anteroposterior direction of the hull 2 at the initial stage immediately before the start of the bow turning mode. When the bow turning mode is started, the steering control operation is started to steer the two electric outboard motors EM in the V-shaped orientation (in the toe-out orientation) and, simultaneously, the propulsive force control operation is started to drive one of the two electric outboard motors EM forward and drive the other electric outboard motor EM reverse. In the example shown, the port-side electric outboard motor EMp is driven forward to generate a forward propulsive force and, therefore, water jet 25 is generated rearward of the port-side electric outboard motor EMp. Further, the starboard-side electric outboard motor EMs is driven in reverse to generate a reverse propulsive force and, therefore, water jet 26 is generated forward of the starboard-side electric outboard motor EMs. When the two electric outboard motors EM are steered to their bow turning mode steering angles in this state, the rear ends of the electric outboard motors EM are moved toward each other. Therefore, the water jet 25 generated rearward by the port-side electric outboard motor EMp hits the starboard-side electric outboard motor EMs, particularly hits the upper housing 56 (rudder plate) of the starboard-side electric outboard motor EMs. This increases the steering load torque of the starboard-side electric outboard motor EMs. Since the starboard-side electric outboard motor EMs should be steered in a direction against the water jet 25 to the bow turning mode starboard-side steering angle, the steering load torque is likely to be excessively increased.

Figure 12:
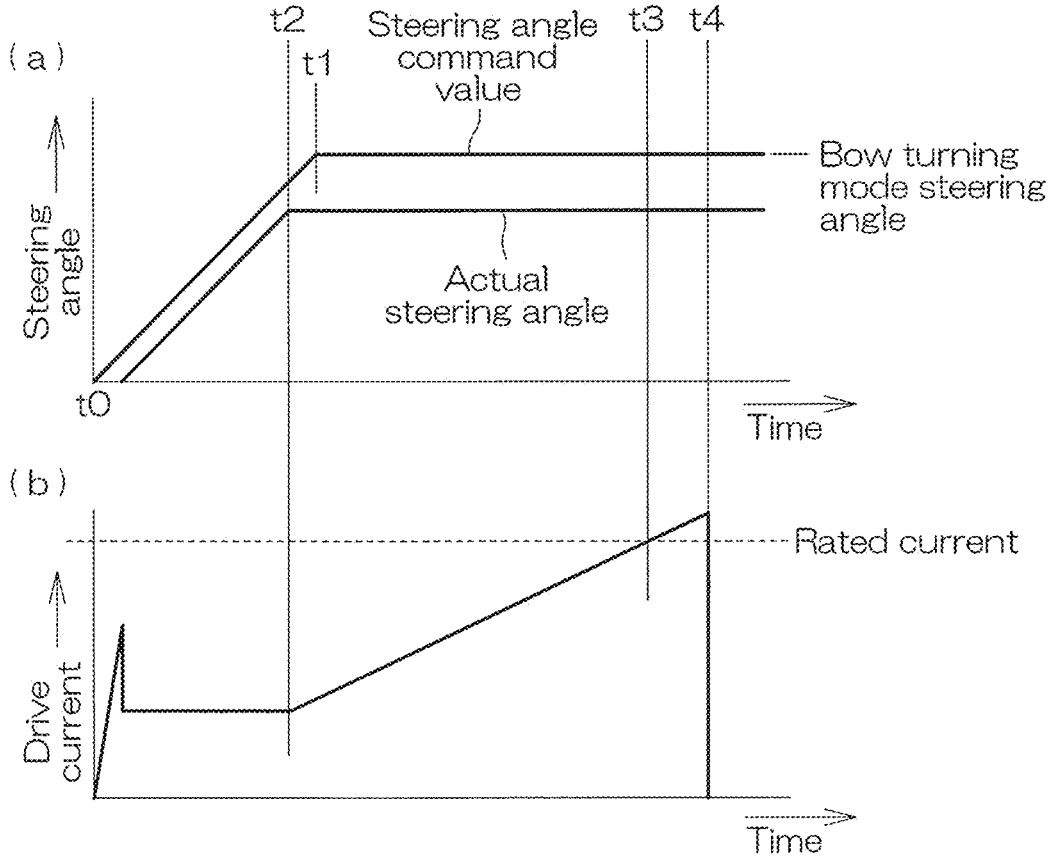
FIG. 12 respectively shows a change in the steering angle of a starboard-side electric outboard motor and a change in the drive current of a steering motor in the exemplary operation of FIG. 11.

FIG. 12(*a*) shows a change in the steering angle of the starboard-side electric outboard motor EMs in the exemplary operation shown in FIG. 11, and FIG. 12(*b*) shows a change in the drive current of the steering motor 30 of the starboard-side electric outboard motor EMs in the same operation. When the bow turning mode is started at time t0, the steering angle command value changes toward the bow turning mode steering angle, and reaches the bow turning mode steering angle at time t1. The actual steering angle changes following the steering angle command value through the feed-back control performed by the steering controller 81 (see FIG. 8). As the steering operation proceeds, however, the steering load torque is increased by the influence of the water jet 25 generated by the port-side electric outboard motor EMp. At time t2 before the bow turning mode steering angle is reached, the output torque of the steering motor 30 is balanced against the steering load torque, so that the actual steering angle no longer changes. On the other hand, the steering controller 81 increases the drive current to be supplied to the steering motor 30 in order to eliminate a difference between the steering angle command value and the actual steering angle. Thus, at time t3, the drive current of the steering motor 30 exceeds the rated current of the steering motor 30. The steering controller 81 detects this state and, at time t4, performs a fail-safe process, for example, to stop the current supply to the steering motor 30.

Figure 13:
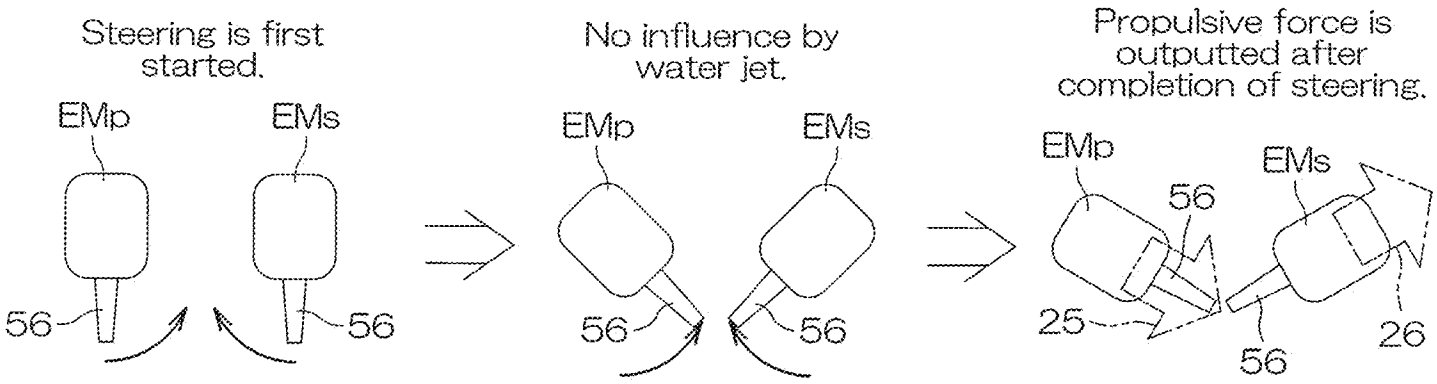
FIG. 13 shows another exemplary operation to be performed at the start of the bow turning mode (according to an inventive example).

FIG. 13 shows another exemplary operation to be performed at the start of the bow turning mode (according to an inventive example). In this example, similarly, the two electric outboard motors EM are each set in the neutral steering position with their propulsive force directions parallel or substantially parallel to the anteroposterior direction of the hull 2 at the initial stage immediately before the start of the bow turning mode. When the bow turning mode is started, the main controller 101 performs the steering control operation to steer the two electric outboard motors EM in the V-shaped orientation (in the toe-out orientation), and performs a propulsive force restricting control operation to restrict the generation of the propulsive forces. Specifically, the propulsive force restricting control operation is a propulsive force reducing control operation in which the propulsive forces of the electric outboard motors EM are controlled to levels lower than the target propulsive forces until the actual steering angles of the electric outboard motors EM reach the bow turning mode steering angles. More specifically, the propulsive force restricting control operation may be a propulsive force generation prohibiting control operation in which the generation of the propulsive forces is prohibited by controlling the propulsive forces at zero until the actual steering angles of the electric outboard motors EM reach the bow turning mode steering angles.

When the actual steering angles of the electric outboard motors EM reach the bow turning mode steering angles, the main controller 101 starts the propulsive force control operation to drive one of the two electric outboard motors EM forward and drive the other electric outboard motor EM in reverse. In the example shown, the port-side electric outboard motor EMp is driven forward to generate a forward propulsive force to generate water jet 25 rearward of the port-side electric outboard motor EMp. Further, the starboard-side electric outboard motor EMs is driven in reverse to generate a reverse propulsive force to generate water jet 26 forward of the starboard-side electric outboard motor EMs.

Figure 14:
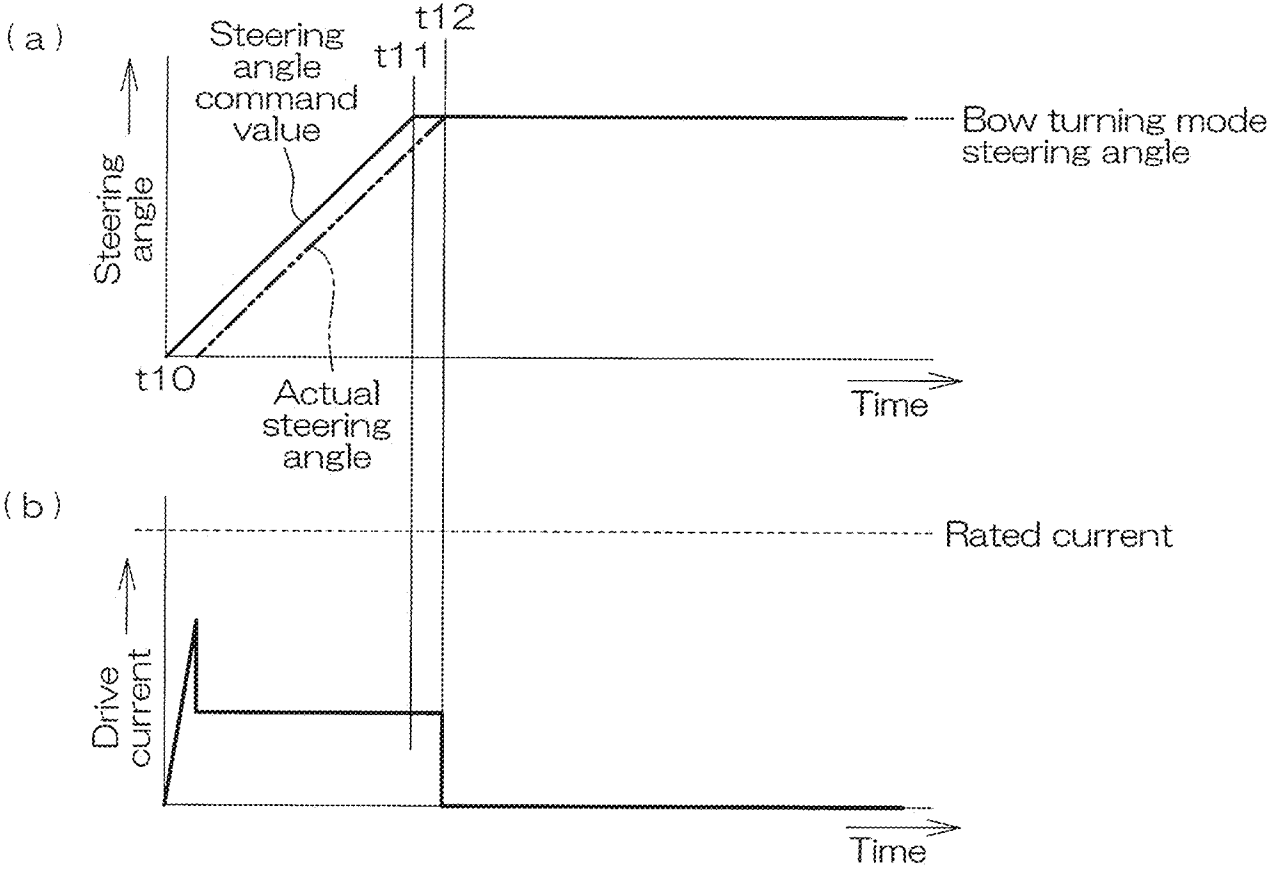
FIG. 14 respectively shows a change in the steering angle of the starboard-side electric outboard motor and a change in the drive current of the steering motor in the exemplary operation of FIG. 13.

FIG. 14(*a*) shows a change in the steering angle of the starboard-side electric outboard motor EMs in the exemplary operation shown in FIG. 13, and FIG. 14(*b*) shows a change in the drive current of the steering motor 30 of the starboard-side electric outboard motor EMs in the same exemplary operation. When the bow turning mode is started at time t10, the steering angle command value changes toward the bow turning mode steering angle and, at time t11, reaches the bow turning mode steering angle. The actual steering angle changes following the steering angle command value through the feed-back control performed by the steering controller 81 (see FIG. 8). Until the actual steering angle reaches the bow turning mode steering angle, the port-side electric outboard motor EMp generates no water jet or generates a weak water jet, so that the steering load torque does not substantially increase. Therefore, the actual steering angle reaches the bow turning mode steering angle at time t12. On the other hand, the steering controller 81 controls the supply of the drive current to the steering motor 30 so as to eliminate a difference between the steering angle command value and the actual steering angle. Unlike in the case of FIG. 12, the actual steering angle reaches the bow turning mode steering angle at time t12. Therefore, the drive current does not continuously increase to more than the rated current, but the supply of the drive current to the steering motor 30 is stopped.

Thereafter, the port-side electric outboard motor EMp starts generating the propulsive force. Therefore, the water jet 25 of the port-side electric outboard motor EMp hits the starboard-side electric outboard motor EMs (particularly, hits the upper housing 56 (rudder plate)) such that the steering load torque occurs. However, the actual steering angle already reaches the bow turning mode steering angle. Therefore, the steering motor 30 is not driven, but the actual steering angle is maintained at the bow turning mode steering angle by the friction of the worm gear/wheel 33.

Figure 15:
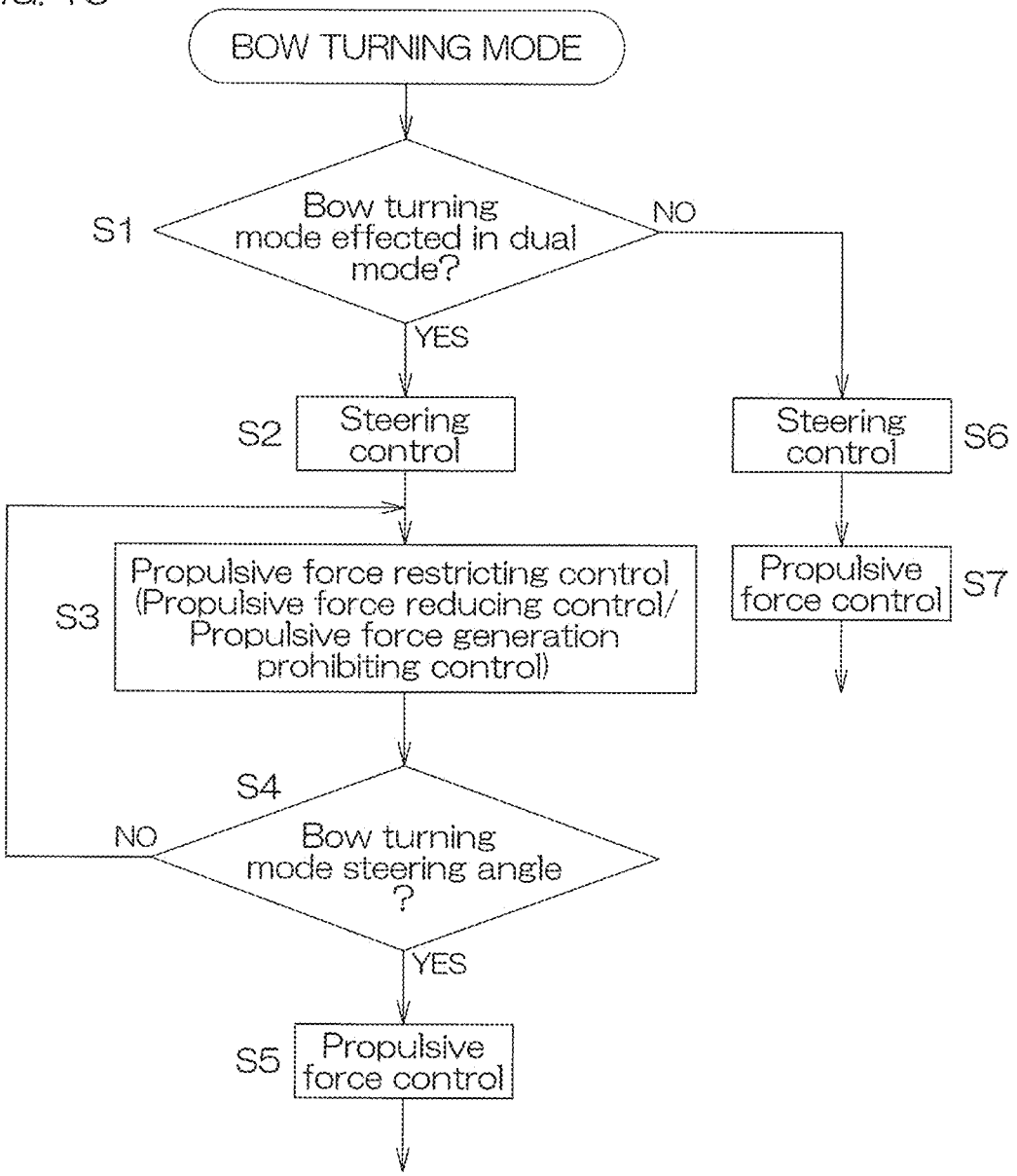
FIG. 15 is a flowchart for describing an exemplary process to be performed by a main controller at the start of the bow turning mode.

FIG. 15 is a flowchart for describing an exemplary process to be performed by the main controller 101 at the start of the bow turning mode. When the joystick 8 is twisted in the neutral position, the main controller 101 starts the bow turning mode. The main controller 101 determines whether or not the bow turning mode is effected in the dual mode (see FIGS. 6B and 9) (Step S1). If the bow turning mode is effected in the dual mode (YES in Step S1), the main controller 101 performs the steering control operation to steer the two electric outboard motors EM in the V-shaped orientation (Step S2), and performs the propulsive force restricting control operation (the propulsive force reducing control operation or the propulsive force generation prohibiting control operation) to restrict (e.g., prohibit) the generation of the propulsive forces of the two electric outboard motors EM (Step S3). The main controller 101 acquires information of the actual steering angles of the two electric outboard motors EM from the steering controllers 81, and continuously performs the propulsive force restricting control operation (the propulsive force reducing control operation or the propulsive force generation prohibiting control operation) until the actual steering angles reach the bow turning mode steering angles (NO in Step S4). If the actual steering angles of the two electric outboard motors EM reach the bow turning mode steering angles (YES in Step S4), the main controller 101 starts the propulsive force control operation to drive one of the two electric outboard motors EM forward and drive the other electric outboard motor EM in reverse according to the twisting direction and the twisting amount of the joystick 8 (Step S5).

If the bow turning mode is not effected in the dual mode (NO in Step S1), i.e., if the bow turning mode is effected in the single mode, the main controller 101 performs the steering control operation to control an energized one of the electric outboard motors EM to a steering angle corresponding to the twisting direction of the joystick 8 (Step S6).

Simultaneously with the steering control operation, the main controller 101 may start the propulsive force control operation to cause the energized electric outboard motor EM to generate a target propulsive force corresponding to the twisting amount of the joystick 8 (Step S7). Alternatively, the main controller 101 may start the propulsive force control operation (Step S7) after the energized electric outboard motor EM is steered to a predetermined steering angle suitable for the fixed-point bow turning behavior.

The bow turning mode effected in the dual mode is an example of the predetermined load torque increase condition in which the water jet generated by one of the two electric outboard motors EM (first propulsion device) is likely to increase the steering load torque of the other electric outboard motor EM (second propulsion device). In the bow turning mode effected in the dual mode, the bow turning mode steering angle (first target steering angle) of one of the two electric outboard motors EM (first propulsion device) is set so that the water jet generated by the one electric outboard motor EM (first propulsion device) is directed toward the other outboard motor EM (second propulsion device). Then, the bow turning mode steering angle (second target steering angle) of the other electric outboard motor EM (second propulsion device) is set so that the other electric outboard motor EM (second propulsion device) is steered in a direction against the water jet. Therefore, the bow turning mode effected in the dual mode is an example of the steering angle condition such that the predetermined load torque increase condition is satisfied. This steering angle condition is a condition such that the bow turning mode steering angles (the first target steering angle and the second target steering angle) are set for the two electric outboard motors EM (the first propulsion device and the second propulsion device) so as to steer the two electric outboard motors EM to move the rear ends of the two electric outboard motors EM toward each other. Further, the steering angle condition is also a condition such that the other electric outboard motor EM (second propulsion device) (particularly, the upper housing 56 (rudder plate) of the other electric outboard motor EM) receives the water jet generated by the one electric outboard motor EM (first propulsion device) due to the steering angle relationship between the two electric outboard motors EM.

While preferred embodiments of the present invention have thus been described, the present invention may be embodied in some other ways.

Figure 16:
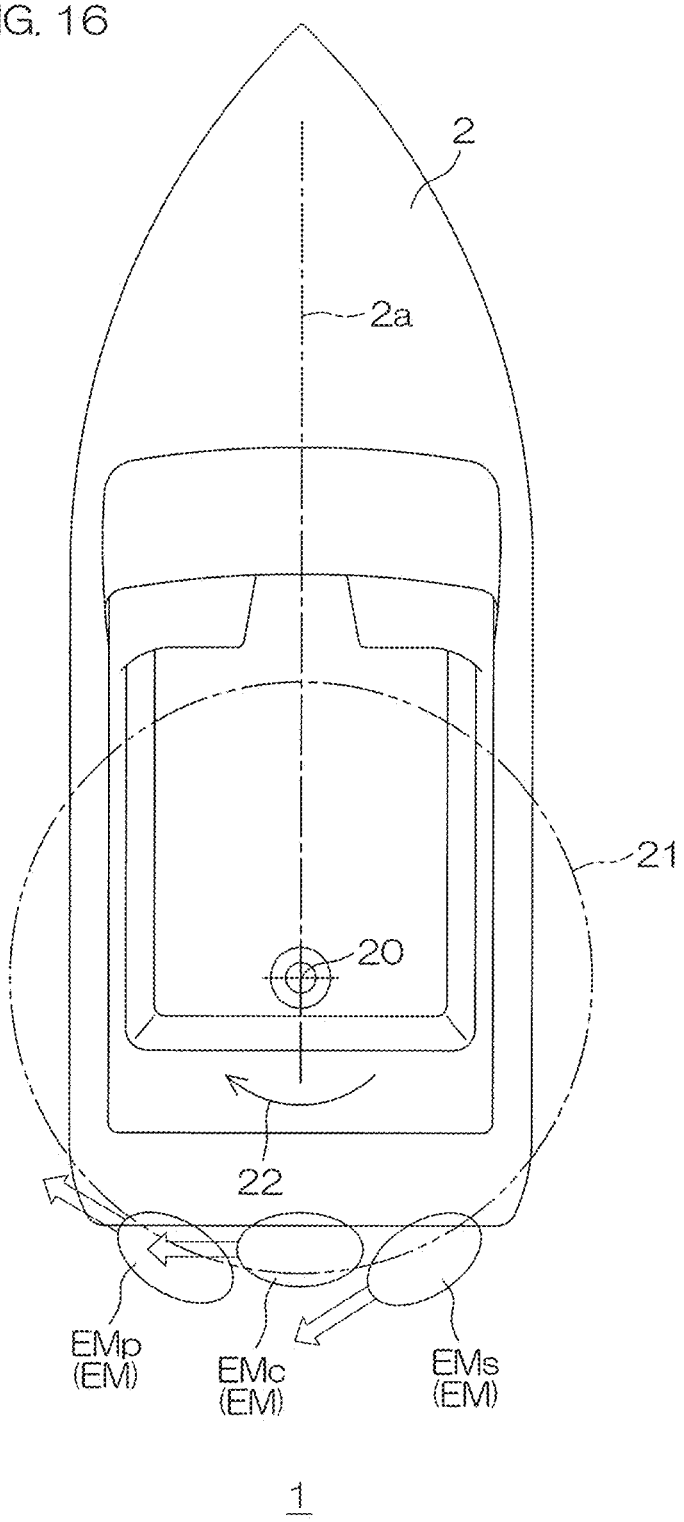
FIG. 16 is a plan view showing an exemplary construction of a watercraft including three electric outboard motors attached to its hull.

In a preferred embodiment described above, the two electric outboard motors EM are disposed side by side on the stern by way of example. Alternatively, as shown in FIG. 16, three or more electric outboard motors EM may be attached to the hull 2. FIG. 16 shows the steering states of three electric outboard motors EM attached to the hull 2 when the bow turning mode is effected in a triple mode in which the three electric outboard motors EM respectively generate propulsive forces. A starboard-side electric outboard motor EMs and a port-side electric outboard motor EMp are steered in a V-shaped orientation. The propulsive force direction of a middle electric outboard motor EMc extends generally transversely of the hull 2. The bow turning mode steering angles and the operation states of the three electric outboard motors EM are controlled so that the three electric outboard motors EM respectively generate propulsive forces tangentially of a circle 21 about the turning center 20 of the hull 2 to apply moments to the hull 2 in the same turning direction 22 (clockwise in FIG. 16) about the turning center 20 of the hull 2. Thus, the three electric outboard motors EM can efficiently apply the moments to the hull 2 and, therefore, can smoothly turn the bow of the hull 2. When the bow turning mode is started, the steering load torques of the respective electric outboard motors EM are likely to be increased by the influence of water jets generated by the adjacent electric outboard motors EM. To compensate for this, the propulsive force control operation is performed to generate predetermined target propulsive forces after the completion of the steering to the bow turning mode steering angles. Thus, the bow turning mode can be smoothly utilized for the watercraft maneuvering.

A preferred embodiment described above is directed to the exemplary case in which the load torque increase condition (steering angle condition) is satisfied when the control mode of the main controller 101 is brought into the bow turning mode. Where the load torque increase condition (steering angle condition) in which the water jet generated by one of the two adjacent propulsion devices is likely to excessively increase the steering load torque of the other propulsion device is satisfied in a control mode other than the bow turning mode, the two propulsion devices can be properly steered to the target steering angles by using preferred embodiments of the present invention.

In a preferred embodiment described above, the electric outboard motors are used as the propulsion devices by way of example, but engine outboard motors each utilizing an engine as a drive source thereof may be used as the propulsion devices. Further, propulsion devices utilizing different types of prime movers may be used in combination (e.g., an engine outboard motor and an electric outboard motor may be used in combination).

In a preferred embodiment described above, the outboard motors are used as the propulsion devices by way of example, but inboard motors, inboard/outboard motors (stern drives), waterjet propulsion devices and other types of propulsion devices may be employed.

The propulsion devices are not necessarily required to be attached to the stern, but a propulsion device such as a trolling motor may be attached to the bow or another portion of the hull.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A watercraft propulsion system comprising:

a first propulsion device attachable to a hull in a steerable manner;

a second propulsion device attachable to the hull adjacent to the first propulsion device in a steerable manner;

a first steering device to steer the first propulsion device;

a second steering device to steer the second propulsion device; and a controller configured or programmed to control the first propulsion device, the second propulsion device, the first steering device, and the second steering device, and configured or programmed to determine whether or not a predetermined load torque increase condition is satisfied in which a steering load torque of the second propulsion device is likely to be increased by a water jet generated by the first propulsion device, and to perform a propulsive force restricting control to restrict a propulsive force of the first propulsion device and a propulsive force of the second propulsion device if the predetermined load torque increase condition is satisfied; wherein the predetermined load torque increase condition includes a steering angle condition such that a first target steering angle is set for the first propulsion device so as to direct the water jet generated by the first propulsion device toward the second propulsion device, and a second target steering angle is set for the second propulsion device so as to steer the second propulsion device in a direction against the water jet.

2. The watercraft propulsion system according to claim 1, wherein the propulsive force restricting control includes a propulsive force reducing control to control the propulsive forces of the first propulsion device and the second propulsion device to levels lower than target propulsive forces until the second propulsion device is completely steered to a target steering angle.

3. The watercraft propulsion system according to claim 1, wherein the propulsive force restricting control includes a propulsive force generation prohibiting control to prohibit the first propulsion device and the second propulsion device from generating the propulsive forces until the second propulsion device is completely steered to a target steering angle.

4. The watercraft propulsion system according to claim 1, wherein the steering angle condition is such that the first target steering angle and the second target steering angle are respectively set for the first propulsion device and the second propulsion device so as to steer the first propulsion device and the second propulsion device to move rear ends of the first propulsion device and the second propulsion device toward each other.

5. The watercraft propulsion system according to claim 1, wherein the controller includes a plurality of control modes including a bow turning mode in which the first propulsion device generates a forward propulsive force and the second propulsion device generates a reverse propulsive force with rear ends of the first propulsion device and the second propulsion device located closer to each other than front ends of the first propulsion device and the second propulsion device; and the predetermined load torque increase condition includes a condition such that the controller is in the bow turning mode.

6. The watercraft propulsion system according to claim 1, wherein the second steering device includes an electric motor defining a drive source.

7. The watercraft propulsion system according to claim 1, wherein the steering angle condition is such that the second propulsion device receives the water jet generated by the first propulsion device due to a steering angle relationship between the first propulsion device and the second propulsion device.

8. The watercraft propulsion system according to claim 1, wherein at least one of the first propulsion device and the second propulsion device is an electric propulsion device including an electric motor defining a drive source.

9. The watercraft propulsion system according to claim 5, wherein in the bow turning mode, the first propulsion device and the second propulsion device respectively generate propulsive forces tangentially of a circle about a turning center of the hull so as to respectively apply moments to the hull in a same turning direction about the turning center of the hull and the circle passes through the first propulsion device and the second propulsion device when viewed in a plan view.

10. A watercraft comprising:

a hull; and the watercraft propulsion system according to claim 1 attached to the hull.

11. A watercraft comprising:

a hull; and the watercraft propulsion system according to claim 9 attached to the hull.

* * * * *